US006619871B2

(12) United States Patent
Furukawa et al.

(10) Patent No.: US 6,619,871 B2
(45) Date of Patent: Sep. 16, 2003

(54) COLLECTOR TYPE WRITING INSTRUMENT

(75) Inventors: Kazuhiko Furukawa, Kanagawa (JP); Yojiro Sano, Tokyo (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/168,114

(22) PCT Filed: Dec. 15, 2000

(86) PCT No.: PCT/JP00/08922

§ 371 (c)(1),
(2), (4) Date: Jun. 17, 2002

(87) PCT Pub. No.: WO01/43986

PCT Pub. Date: Jun. 21, 2001

(65) Prior Publication Data

US 2002/0192008 A1 Dec. 19, 2002

(30) Foreign Application Priority Data

Dec. 16, 1999 (JP) ..... 11-357136
Dec. 16, 1999 (JP) ..... 11-357138
Dec. 16, 1999 (JP) ..... 11-357139
Dec. 16, 1999 (JP) ..... 11-357277

(51) Int. Cl.[7] ..... B43K 5/02
(52) U.S. Cl. ..... 401/224; 401/227
(58) Field of Search ..... 401/223, 224, 401/225, 226, 227

(56) References Cited

U.S. PATENT DOCUMENTS 5,938,362 A * 8/1999 Bastiansen ..... 401/227
6,302,610 B2 * 10/2001 Mito et al. ..... 401/227
6,398,442 B1 * 6/2002 Furukawa ..... 401/227

FOREIGN PATENT DOCUMENTS

| | | | |
|---|---|---|---|
| JP | 59-184682 | U | 12/1984 |
| JP | 3-31580 | Y2 | 7/1991 |
| JP | 3-31581 | Y2 | 7/1991 |
| JP | 4-227886 | A | 8/1992 |
| JP | 6-36886 | U | 5/1994 |
| JP | 6-36886 | | 5/1994 |
| JP | 6-72671 | U | 10/1994 |
| JP | 9-104194 | A | 4/1997 |
| WO | WO 99/56969 | A1 | 11/1999 |

* cited by examiner

*Primary Examiner*—David J. Walczak
(74) *Attorney, Agent, or Firm*—Burns, Doane, Swecker & Mathis, L.L.P.

(57) ABSTRACT

A collector type writing instrument which is formed with a sectioning portion for substantially separating its ink tank and a snorkel having a tubular vent portion for establishing air communication between the front and rear spaces divided by the sectioning portion, wherein at least one ink conduit of a size smaller than that of the vent portion is formed in the sectioning portion. Further, a clearance portion allowing for ink and air bubbles to move therethrough is provided between the collector and snorkel. In addition, the parts present from the sectioning portion to the rear end of the collector are laid out so that ink will be able to spread and wet the surfaces of the parts other than the ink tank. It is also preferable that the end of the tubular vent portion of the snorkel is cut so as to enlarge the opening. The writing instrument is configured so as to satisfy the relations Ts>Is and Tt>It, where 'Ts' is the total minimum cross-section of the vent portion, 'Tt' is the total distance of the vent portion, 'Is' is the total minimum cross-section of the ink conduit and 'It' is the total distance of the ink conduit.

13 Claims, 27 Drawing Sheets

COLLECTOR TYPE WRITING INSTRUMENT

TECHNICAL FIELD

The present invention is directed to improvement of so-called collector type writing instruments, such as ball-point pens, felt tip pens, markers, fountain pens, small-tube writing instruments and the like, having a writing point at the front end thereof, an ink tank for directly storing ink and a collector or grooved adjuster for absorbing variation in internal pressure. In particular, the present invention relates to improvement of the mechanism to solve the flooding problem occurring when a collector type writing instrument is used under conditions in which a sharp pressure variation occurs such as on an airplane.

BACKGROUND ART

Writing instruments which have a collector 6 as an internal pressure adjuster, disposed between a conventionally existing point assembly 1 and ink tank 3, for retaining free-state ink 2 and adjusting the pressure inside ink tank 3 so as to prevent ink leakage from a tip 9 of point assembly 1 and ink flooding from an air hole 10 have been known (see FIG. 27). A collector type writing instrument can adjust the internal pressure balance by holding ink 2 of a relatively low viscosity from ink tank 3 within retaining grooves 13 formed in collector 6 and returning ink to ink tank 3, meaning that it provides the function of protecting the writing point from the influence of changes in pressure. A collector type writing instrument has excellent performance such as capabilities of providing an ample amount of ink, securing the stable amount of ink flow down to the last drop and allowing for the amount of ink 2 left to be checked from the outside.

However, since the collector type writing instruments store ink 2 directly and allow movement of ink 2 to and from collector 6, there is a serious drawback that ink 2 will flood outside through air hole 10 of the writing instrument there being no space for withholding ink 2, thereby polluting fingers or clothes if the writing instrument is exposed to an environment in which the ink inside collector 6 exceeds the maximum capacity of retention, which is the limitation of the internal pressure adjustment capacity. As the countermeasures for solving this problem or increasing the safety to some degree, it is possible to make collector 6 greater in capacity or make ink tank 3 smaller. There have already been writing instruments sold on the market which use a collector capable of preventing ink flood under usual environments, meaning gentle temperature changes and the like.

As the current situation is that collector type writing instruments use rather thick barrels, taking a safety margin into account, use of a thicker barrel than the present situation makes the instrument difficult to grip and loses the stylishness. When ink tank 3 is made smaller, reduction of ink stored makes the life short. When the normal collector 6 is made longer, the ink head H becomes higher because the ink head H acting on point assembly 1 is proportional to the height from the air/liquid exchanger 18 to the tip 9 of the writing assembly, hence forward leakage of ink 2 from tip 9 occurs due to gravity.

On the other hand, when a writing instrument which has been capped under about 1 atm. on the ground and is uncapped inside an airplane in which the air pressure is generally reduced to about 0.8 atm., the interior of the pen which has been balanced under 1 atm., is instantaneously exposed to an environment of about 0.8 atm., so ink 2 inside moves in a rush and floods the space around the air channel of collector 6, whereby ink 2 floods out from air hole 10, being unable to be properly retained by the whole part of retaining grooves 13. In order to solve the flood problem occurring under conditions in which the air pressure varies, devices and inventions have been disclosed in Japanese Utility Model Publication Hei 3 No.31580, Japanese Utility Model Publication Hei 3 No.31581 and Japanese Patent Application Laid-open Hei 9 No.104194, and others. However, these disclosures only provide the function of blocking the flush to directly reach the air hole, which is not efficient enough, hence a further effective improvement or other ways to reach a solution have been demanded.

There has been an invention which uses an air supply pipe and the like as disclosed in Japanese Patent Application Laid-open Hei 4 No.227886. However, the conventional invention has the problem that the instrument cannot write continuously unless the writing element is turned down-side up for ink supply and also has the problem of ink capacity being only half filled up from the beginning. Therefore, it is necessary to add such usage instructions or explanation as to the initially reduced amount of ink, for the consumers. Since it is considered that the instrument may be used in an environment in which sharp increase and reduction in air pressure repeatedly occur as in the situations where the instrument is carried over from one airplane to another or from low temperature outdoor air to the front of a heater, there have been demands for excellent free-ink collector type writing instruments which do not need any usage explanation to consumers as above, adopt effective countermeasures against such repeated changes and still can provide beneficial writing comfort (writing performance) making use of low-viscosity ink.

Further, since collector type writing instruments have the problem that the life of writing abruptly ends when ink runs out, it is necessary to carry a spare if the writing instrument has a low amount of ink. There is a demand for collector type writing instruments which can provide an ample amount of ink, which is the main feature of collector type writing instruments, until nearly the end of writing and can provide the performance of a fabric sliver type instrument, which delivers gradually reducing amounts of ink, for a short time so that the pen can be used to take some notes after the last drop of ink is used up. There are also other problems, including the problem of ink dropping from the writing point making it difficult to write when the pen has been kept upside down for long time and the problem of ink leaking forwards due to deficiency of the inherent function of a collector type writing instrument because ink drops and the air/liquid exchanger dries when the pen is held with its tip up and the air/liquid exchanger cannot be wetted again with ink even when the pen is returned with its tip down if there is a part in the way that blocks ink. Even when an equal amount of ink is loaded, a collector type writing instrument delivers a greater amount of ink than a conventional fabric sliver type writing instrument and hence has a shorter life. Therefore, there is a demand that downsizing of the ink tank volume should be avoided as far as possible. There is a demand for solving these problems.

As ink 2 is consumed during writing, collector type writing instruments are adapted to take external air into the ink tank 3 side through air/liquid exchanger 18 so as to avoid reduction in internal pressure (FIG. 27). Therefore, it is usually necessary to provide a space in the rear of collector 6 for allowing free movement of air bubbles. As conventionally disclosed in Japanese Utility Model Application Laid-open Sho 59 No.184682 and other publications, there are configurations in which a solid article such as an ink absorber etc., is arranged in the ink tank, in contact with the rear of the collector. In such a configuration, if air bubbles arising at the air/liquid exchanger do not pass through the ink absorber, which is wetted with ink, without resistance, the ink absorber itself will function as a second air/liquid exchanger, whereby the internal pressure inside the writing instrument lowers, causing ink starvation and other writing deficiencies.

To solve the above problem, it is necessary to provide an arrangement which will not confine the rear of the ink collector or any other countermeasure. However, the air/liquid exchanger in the collector is usually provided at a single site, meaning that the position of the air/liquid exchanger should be well adjusted to that of the air bubble passage of the ink absorber when assembled. Further, the ink absorber and other parts may move forwards due to being dropped or other impacts, so that the space for allowing movement of air bubbles is displaced or the air flow channel for relieving air from the ink tank when a sharp change in pressure occurs becomes narrow. Thus, solution to these problems is wanted.

It is therefore a main object of the present invention to provide improvement of collector type writing instruments. In detail it is an object to provide a writing instrument which, without the necessity of a special configuration limiting the usage, can avoid crucial accidents such as pollution of consumer's clothes or fingers, due to forward leakage of ink 2 from tip 9 of point assembly 1 or flooding of ink 2 from air hole 10 exceeding the limit of the pressure adjustment capacity of collector 6, by absorbing the variation in pressure inside ink tank 3 resulting from change in temperature or air pressure.

There has been a demand for solution to the defect of collector type writing instruments, i.e., the liability to cause flooding especially when they are used on an airplane or under an environment in which sharp temperature change occurs, therefore it is an object to provide an inexpensive collector type writing instrument with the above problem removed while the appearance and writing distance(life) are maintained as before.

DISCLOSURE OF INVENTION

In general, collector type writing instruments include ball-point pens, fountain pens, small-tube writing instruments which have an ink feeder core (center core 8 and/or collector core 7) for assuring the flow path of ink 2 having a low viscosity(100 mPa·s or lower) from an ink tank 3 to a writing point 9 provided at the tip of a point assembly 1 or which have an ink feeder portion made up of a slit(in the case where a vertical groove 14 is extended to the tip) in a collector 6, and felt tip pens, markers and the like in which center core 8 or collector core 7 itself serves as a writing tip 1. Hereinbelow, ink feeder cores(center core 8, collector core 7, etc.) will also include those which themselves serve as pen tips.

Arranged between ink tank 3 of a cup-like shape having a bottom integrally formed or assembled with a separate part such as a tail plug or the like and a point assembly is a collector 6, which may be formed of a plurality of retaining grooves 13 (generally, gaps defined by a plurality of vanes 12), an air groove 15 connected to the external air and a narrow longitudinal groove 14 creating communication between retaining grooves 13 or which may be made up of a fiber bundle, so as to retain ink 2 using capillarity. An air/liquid exchanger 18 of a small enough size is provided for collector 6 and is adapted to be wetted with ink 2, so that ink tank 3 can be isolated from the external air and air will not enter ink tank 3 from the outside other than through air/liquid exchanger 18.

In the present invention, a collector writing instrument is first provided with a snorkel 25, as an effective means of the present invention, which has a tubular vent portion 27, formed integrally or by assembly of parts, for releasing the air expanded in the rear part inside ink tank 3 to the collector 6, 6*a* side to thereby prevent application of pressure on ink 2. This arrangement functions as an effective means to prevent ink from flooding when ink 2 has been consumed to some degree or the air inside ink tank 3 occupies the interior space to a certain degree in a state where point assembly 1 is placed downwards. The snorkel 25 is formed integrally or as a separate part, with a sectioning portion 26 for virtually separating ink tank 3, so that air can be easily ventilated through vent portion 27 of snorkel 25. An ink conduit 30 made up of a groove, hole or the like having a smaller size than that of vent portion 27 is formed in either sectioning portion 26 or the ink tank inner wall or both.

As another effective means of the present invention, an ink absorber 31 made up of a fabric sliver, sponge, fiber bundle, foamed material, or the like capable of retaining ink is incorporated in ink tank 3 and connected to center core 8, collector core 7 or longitudinal groove 14 for leading ink 2 from ink tank 3 to point assembly 1. Ink absorber 31 is configured so that its length at least reaches to a position more rearward than the approximate center of ink tank 3 and its radial dimension is sized so as to create a space around itself for permitting free-state ink 2 to move freely. Further, the ink absorber is configured so as to be able to absorb ink 2 from both the front and rear parts, divided by the aforementioned sectioning portion 26 of snorkel 25. As ink absorber 31, a fiber bundle core which is formed by bonding or forming ordinary fibers with adhesives or with heat, a fabric sliver made up of soft fibers covered by a cladding, a continuous-foamed sponge and others can be used. In order to use ink 2 efficiently, necessary methods such as lowering the capillarity to a level smaller than that of center core 8 and collector core 7 may be employed as appropriate.

In order to avoid reduction in the ink capacity of ink tank 3, it is preferred that the volume of snorkel 25 itself is as small as possible. In the present invention, it is possible to avoid the barrel size becoming inefficiently greater if the parts are made as slim as possible by thinning unnecessary walls and shapes after achievement of the above means. From this viewpoint, vent portion 27 and sectioning portion 26 were designed so that these parts could be laid out by combination of ink absorber 31 and ink tank inner wall 34, whereby redundant parts were cut off to increase the capacity of ink tank 3.

As a further effective means of the present invention, in order for air bubbles, which are formed when air enters ink tank 3 through air/liquid exchanger 18 of collector 6, 6*a* from the outside during writing, to be able to move to the rear space without receiving significant friction from the aforementioned ink absorber 31 and snorkel 25 etc., a clearance portion 42 is provided between the collector 6, 6*a* and snorkel 25. When the writing instrument is dropped with its front first, the inner parts of the writing instrument will move forwards. Since it is difficult to fix ink absorber 31 because it is formed of a fiber bundle or the like, and since it absorbs ink and hence gains weight, it is preferred if some kind of movement preventing means is provided.

In view of what has been described above, in the present invention, a spacer portion 43 having a projection 44 or air bubble passage channel 45 shaped so as to limit the size of the aforementioned clearance portion 42 is provided. This clearance portion 42 is to secure the space for permitting air bubbles arising from air/liquid exchanger 18 to smoothly pass into ink tank 3. Particularly, this structure is provided in order to limit the movement of the contents due to its being dropped or to protect deterioration of writing performance even when the contents have moved.

Further, ink tank 3 incorporates an ink absorber 31 capable of storing ink so as to connect ink to a center core 8 or a collector core 7 which leads ink from ink tank 3 to point assembly 1, and the ink absorber 31 is configured so that its length at least reaches to a position more rearward than the approximate center of ink tank 3 and its radial dimension is sized so as to create a space around itself in ink tank 3 for permitting free-state ink 2 to move therein and out thereof. The ink absorber 31 is configured so as to be able to absorb ink 2 at least through its front and rear openings, and the spacer portion 43 is formed with an air bubble passage channel 45 that will not block at least part around the front end of ink absorber 31 and an abutment 47 for limiting forward movement of ink absorber 31. Since spacer portion 43 has air bubble passage channel 45 that will not block at least part of the front end of ink absorber 31, air bubbles can smoothly move into ink tank 3. Since provision of abutment 47 limits forward movement of ink absorber 31, it is also possible in this case to secure a space through which air bubbles are allowed to move smoothly.

This spacer portion 43 may be formed as a separate part but can be integrally formed at the rear end portion of collector 6, 6*a*, so as to reduce the number of parts.

The clearance portion 42 also functions as the air passage for releasing air of a relatively high inner pressure inside ink tank 3 when the ambient environment around the writing instrument is relatively low in pressure.

As an effective means of the present invention, the parts present from sectioning portion 26 to the rear end of collector 6, 6*a*, except ink tank 3 are integrally molded with, fixed close to with a small enough gap therebetween or fixed in contact with, at least one of ink tank 3, sectioning portion 26 and the collector while the parts present from sectioning portion 26 to the rear end of the collector except ink tank 3 are laid out so that ink 2 will be able to spread and wet the surfaces of all the parts other than inner wall 34 of ink tank 3.

In sum, when the writing instrument is put downwards during normal writing, air/liquid exchanger 18 can be wetted with ink 2 which flows from ink tank 3 to the exchanger via the rear end of collector 6, 6*a*. Accordingly, it becomes possible to positively achieve the function of a so-called collector writing instrument, by creating a reduced pressure state inside ink tank 6, 6*a*, making use of a small-diametric meniscus mechanism.

As the second means of the present invention, an ink absorber 31 made up of a fabric sliver, sponge, fiber bundle, foamed material or the like capable of retaining ink is incorporated in ink tank 3 and connected to center core 8, collector core 7 or longitudinal groove 14, in order to lead ink 2 from of ink tank 3 to point assembly 1. Ink absorber 31 is configured so as to at least reach to a position more rearward than the approximate center of ink tank 3 and so that ink can be absorbed through at least both the front and rear parts of ink absorber 31. As ink absorber 31, a fiber bundle core which is formed by bonding or forming ordinary fibers with adhesives or with heat, a fabric sliver made up of soft fibers covered by an unabsorbent cladding, a shaped mass of foamed sponge and others can be used. In order to use ink 2 efficiently, necessary methods such as lowering the capillarity to a level smaller than that of center core 8 and collector core 7 may be preferably employed as appropriate.

When the writing instrument is assembled or when the writing instrument is put with its tip downwards, it is preferred that the above ink absorber 31 and snorkel 25 will not move easily, in order to stop the contents rattling or in order to positively retain absorbed ink 2.

In the present invention, snorkel 25 is formed with a holder portion 46 producing friction against ink absorber 25 so as to hold it with a strength at least greater than that which will stop ink absorber 31 falling due to gravity when the writing instrument is put stationarily.

Holder portion 46 is constructed so as produce a frictional force (preferably the frictional force should be equal to or greater than the weight of the ink absorber plus the weight of ink and equal to or lower than 100 N under which easy assembly is assured and the frictional force ranging 3 N to 30 N is more preferable.) against ink absorber 31, which is equal to or greater than the weight of ink absorber 31 so that the ink absorber 31 will not move when the writing instrument remains stationary. Specifically, undercuts or a small-diametric portion was formed integrally with snorkel 25 or as a separate part so that ink absorber 31 could be press fitted.

If the writing instrument is dropped with its front side down (point assembly 1 down), it often happens that the inner parts inside the writing instrument move forwards causing deficiencies. Since it is difficult, however, to fix ink absorber 31 because it is formed of a fiber bundle or the like, and since it absorbs ink and hence gains weight, it is preferred if some kind of movement preventing means is provided. Further, when considering the conveyance during assembly, it is necessary that ink absorber 31 and snorkel 25 will not move at least due to gravity. It is preferred and important that they will not move even upon its being dropped. As the third effective means of the present invention, ink tank 3 incorporates an ink absorber 31 capable of storing ink so as to connect ink to a center core 8 or a collector core 7 which leads ink from ink tank 3 to point assembly 1, and the ink absorber 31 is configured so that its length at least reaches to a position more rearward than the approximate center of ink tank 3 and so as to be able to absorb ink through front opening 28 and rear opening 29, and the snorkel 25 has an abutment 47 for at least stopping ink absorber 31 from moving forwards (toward the point assembly).

As the fourth effective means of the present invention, vent portion 27 of snorkel 25 has front opening 28 and rear opening 29, and the front opening 28 opens at a position around ink conduit 30 or more frontward and closer to the point assembly 1 side than ink conduit 30 while the rear opening 29 opens at a position more rearward, with respect to the axial direction, than ink conduit 30 and the arrangement is configured so that relations Ts>Is and Tt>It hold, where 'Ts' is the total minimum cross-section of vent portion 27, 'Tt' is the total distance of the vent portion, 'Is' is the total minimum cross-section of ink conduit 30 and 'It' is the total distance of the ink conduit. The total minimum cross-section is the sum of minimum cross-sections on the assumption that there are a number of conduits or vents. The total distance is the sum of distances(the total unfolded length including zigzag or bent paths) and the like, similarly on the assumption that there are a number of conduits or vents.

In one word, vent portion 27 is configured so that it will produce less flow resistance against flow of ink 2 or air than ink conduit 30 does and so that ink 2 will easily and naturally flow from ink tank 3 to the collector 6, 6*a* side when point assembly 1 is set downwards. Snorkel 25 can be formed of resins such as transparent ABS, AS, PS, PP, PE, PET, PC, transparent PA and others, and these resins kneaded with additives such as surfactants and the like, various alloys. Anyway, the snorkel is a molding of materials which contain transparent resins having resistance to ink.

As fifth effective means of the present invention, an ink absorber 31 made up of a fabric sliver, sponge, fiber bundle, foamed material, or the like capable of retaining ink is incorporated in ink tank 3 and connected to center core 8, collector core 7 or longitudinal groove 14, in order to lead ink 2 from the interior of ink tank 3 to point assembly 1. Ink absorber 31 is configured so that its length at least ranges from a position more frontward to a position more rearward with respect to the approximate center of the portion where free-state ink is stored in ink tank 3, and ink absorber 31 can absorb ink 2 from both its front and rear parts. As ink absorber 31, a fiber bundle core which is formed by bonding or forming ordinary fibers with adhesives or with heat, a fabric sliver made up of soft fibers or continuous-foamed sponge covered by an unabsorbent cladding can be used. In order to use ink 2 efficiently, necessary methods such as lowering the capillarity to a level smaller than that of center core 8 and collector core 7 may be employed as appropriate.

As the sixth effective means of the present invention, a space which allows ink 2 to flow and permits the amount of ink 2 left to be checked from the outside is created around ink absorber 31 by transparent ink tank 3, collector 6, 6*a*, and ink absorber 31 while rear opening 29 of snorkel 25 is made to open at the approximate center (preferably at around the centroid of the ink storage portion) of the portion where free-state ink is stored in ink tank 3 and front opening 28 of snorkel 25 is made to open at a position around the rear end of collector 6.

Here, relation $3{:}K>Ts\cdot Tt>0.01\cdot Y>Is\cdot It$ and relation $4{:}Is>2\cdot B\cdot B$ (greater than two times of B squared) hold, where 'Ts' is the total minimum cross-section of the vent portion, 'Tt' is the total distance of the vent portion, 'Is' is the total minimum cross-section of the ink conduit, 'It' is the total distance of the ink conduit, 'Y' is the maximum ink capacity of the ink tank, 'K' is the maximum ink retention capacity of the collector and 'B' is the minimum width of the air/liquid exchanger. Here, the total minimum cross-section and the total distance are defined in the same way as above.

The knowledge that the collector will work well if its retention capacity is set at 10 to 30% of a typical tank volume has been already known. The vent portion volume of snorkel 25 is sized so as be smaller than the collector's volume and greater than that needed for air bubbles to move. The ink conduit 30 is sized so that air bubbles will be unlikely to move and ink 2 will receive no resistance and be able to move more easily therethrough than they passes through air/liquid exchanger 18 of collector 6, 6*a*. In other words, the ink conduit is sized so that capillary action for promoting ink communication can be obtained. When the cross-section of ink conduit 30 is formed to be greater than the size of the meniscus (width B squared) of air/liquid exchanger 18, it is possible to eliminate the occurrence of the deficiency that ink 2 will not move from rear tank 38 to front tank 37 by the formation of a meniscus at ink conduit 30 like air/liquid exchanger 18 of collector 6 does.

As the eighth effective means of the present invention, the end of the vent portion of the snorkel is formed with a beveled portion. Provision of such a beveled portion enables air bubbles to easily depart from the rear opening. Thereby it is possible to solve the problems of air bubbles congesting in the vent portion and producing a bad effect on writing performance.

BEST MODE FOR CARRYING OUT THE INVENTION

Figure 10:
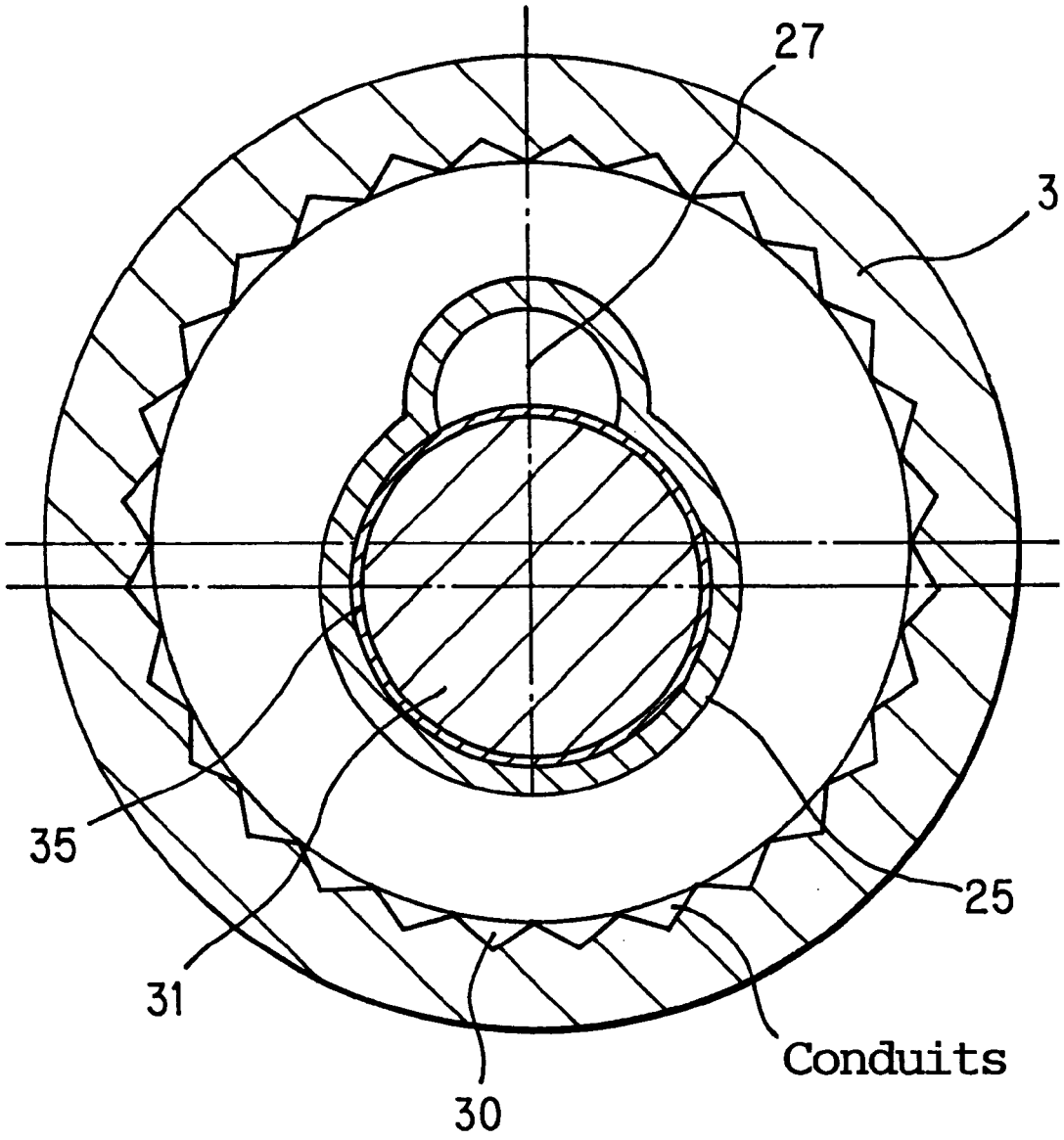
FIG. 10 is an illustrative view showing another type of ink conduit according to the first embodiment of the present invention.
Figure 11:
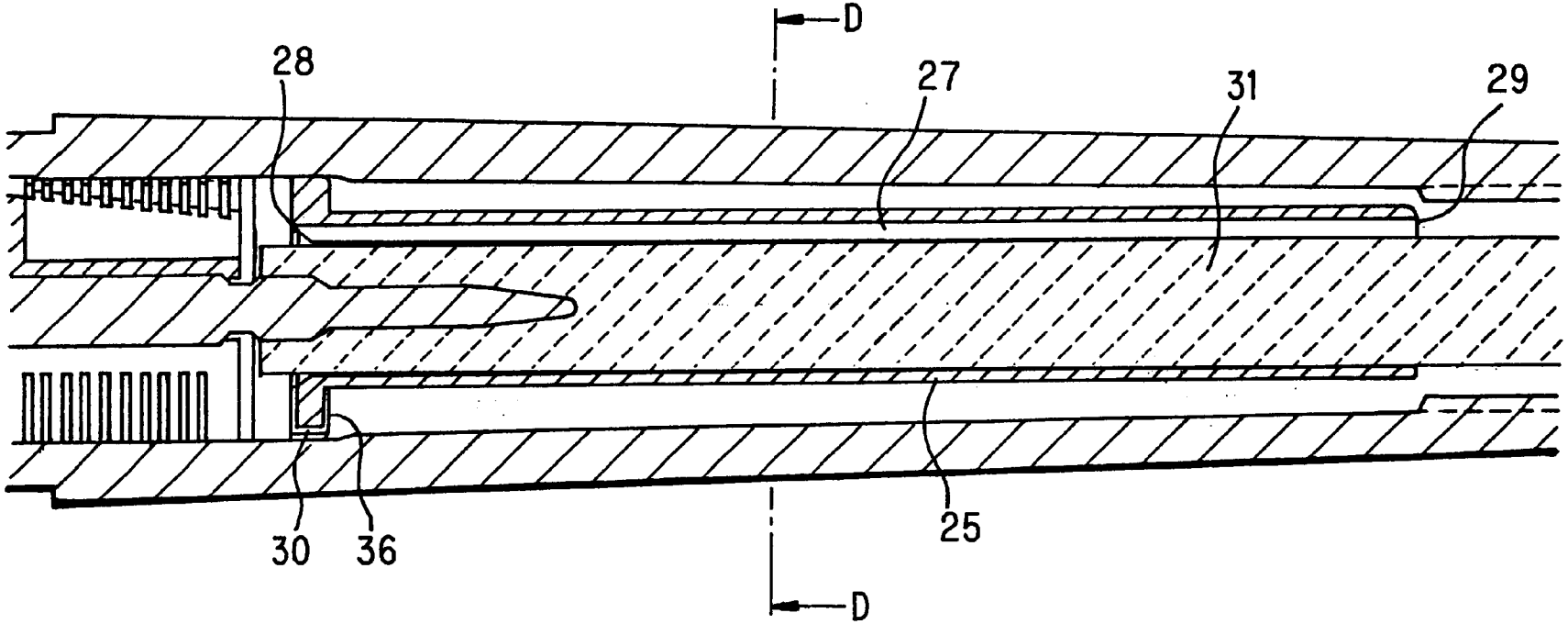
FIG. 11 is an enlarged vertical sectional view showing part of a writing instrument of a second example according to the first embodiment of the present invention.
Figure 12:
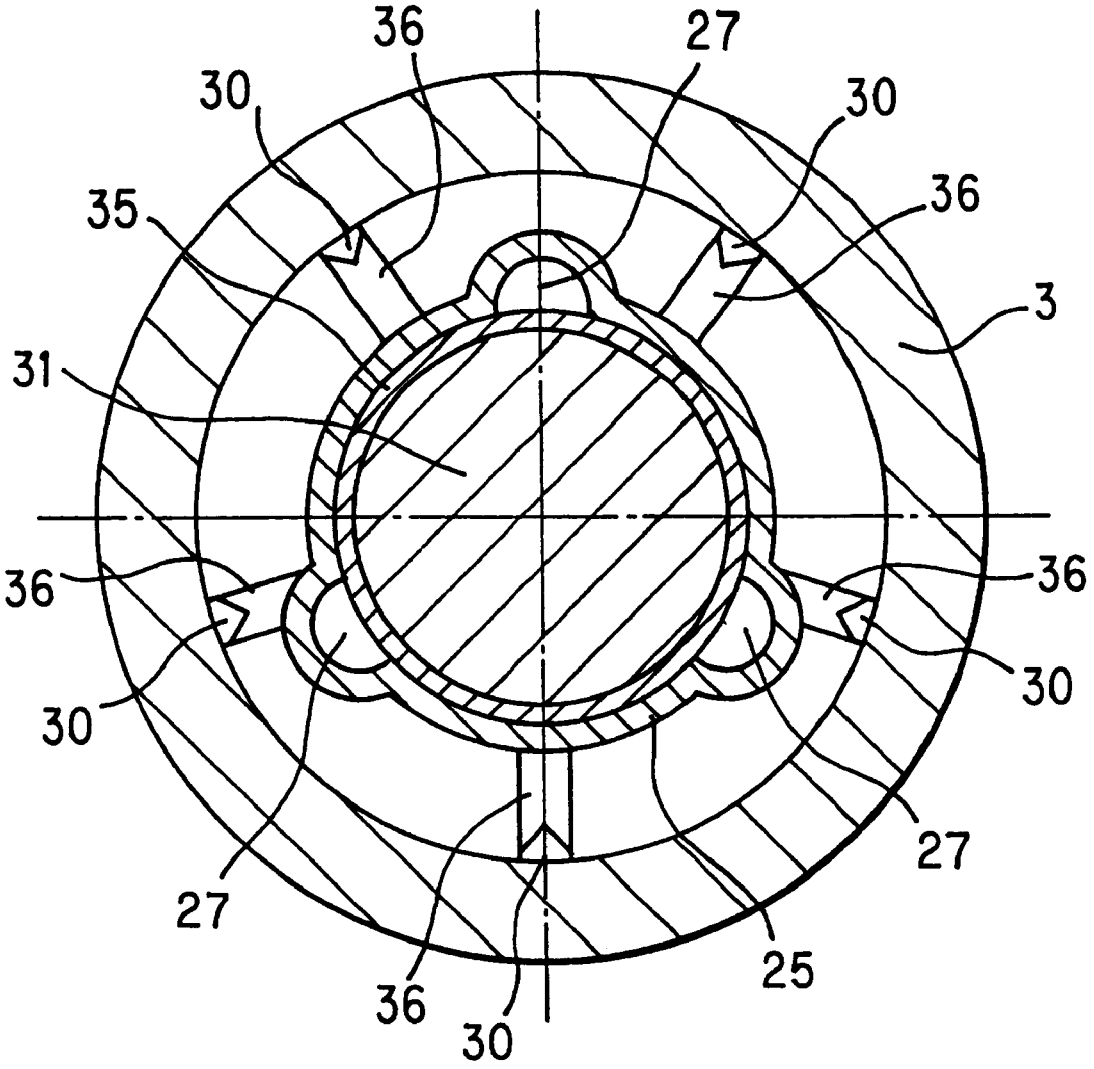
FIG. 12 is a cross-section cut along D—D in FIG. 11.
Figure 13:
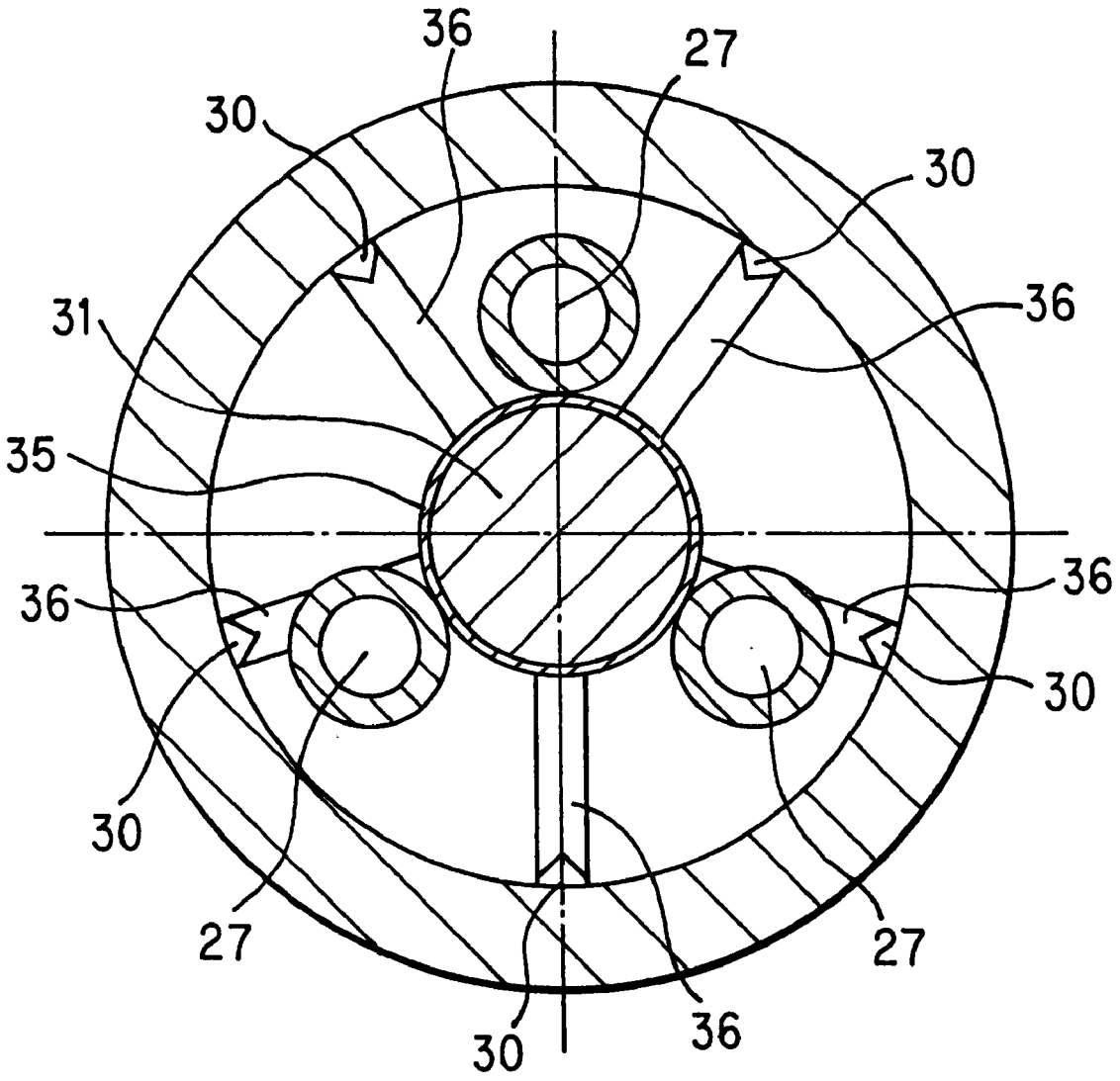
FIG. 13 is an illustrative view showing a snorkel according to a third example of the first embodiment of the present invention.
Figure 14:
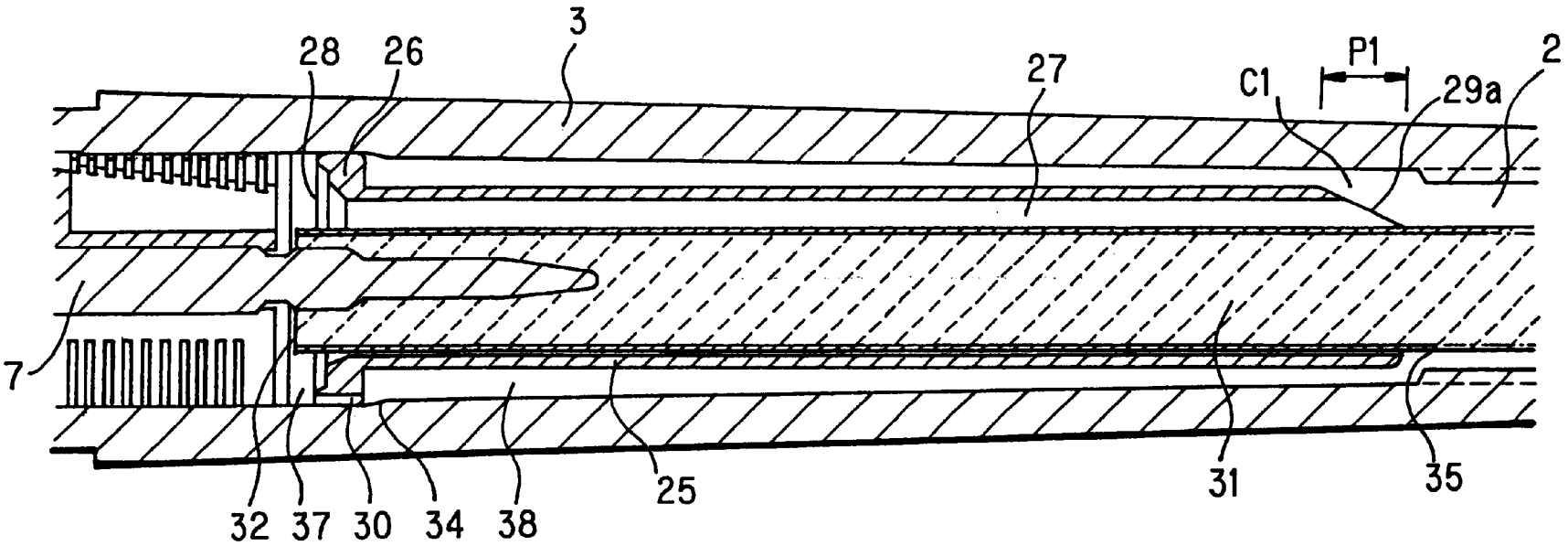
FIG. 14 is an enlarged vertical sectional view showing part of a writing instrument of a fourth example according to the first embodiment of the present invention.
Figure 15:
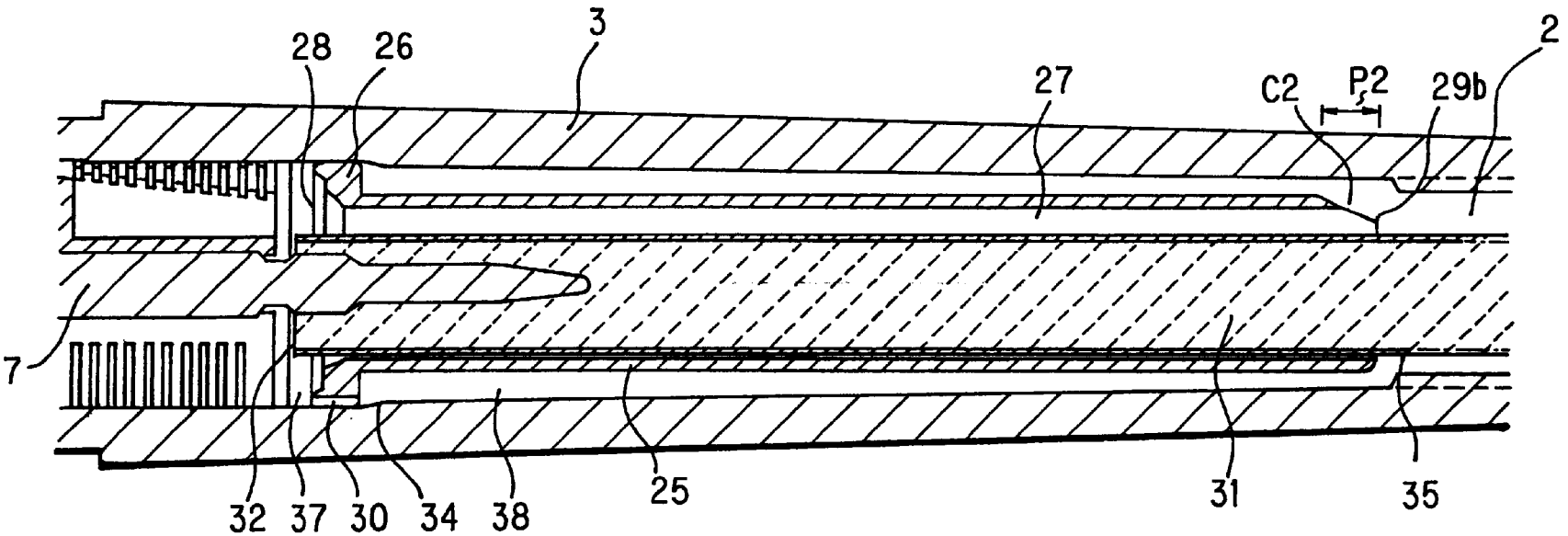
FIG. 15 is an enlarged vertical sectional view showing part of a writing instrument of a fourth example according to the first embodiment of the present invention.
Figure 16:
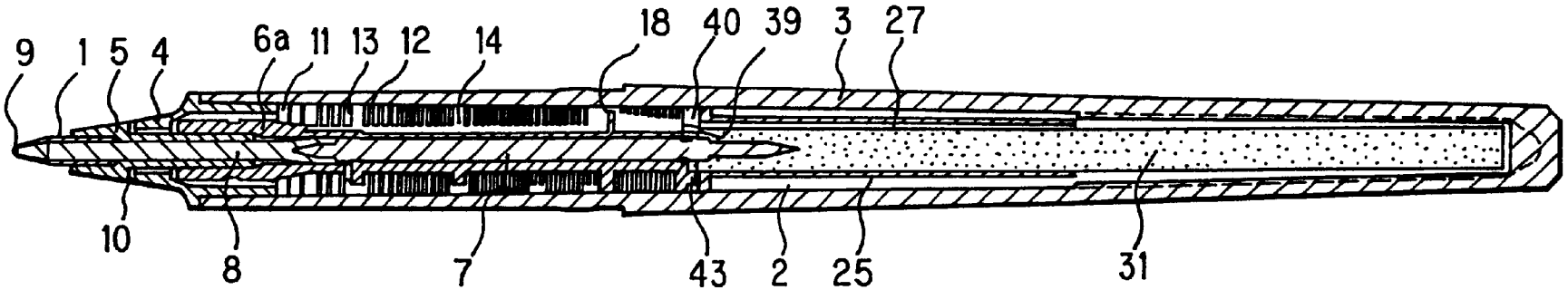
FIG. 16 is a vertical sectional view showing the whole writing instrument of a first example according the second embodiment of the present invention.

Now, the illustrated examples will be detailed. FIGS. 1 to 10 illustrate the first embodiment of the present invention. A first example of the present invention is shown in FIGS. 1 to 10, a second example is shown in FIGS. 11 and 12, a third example is shown in FIG. 13 and a fourth example is shown in FIGS. 14 and 15.

The same components as those described above are allotted with the same reference numerals without description. This reference should be applied to all the embodiments hereinbelow. The present invention will be described hereinbelow.

Figure 1:
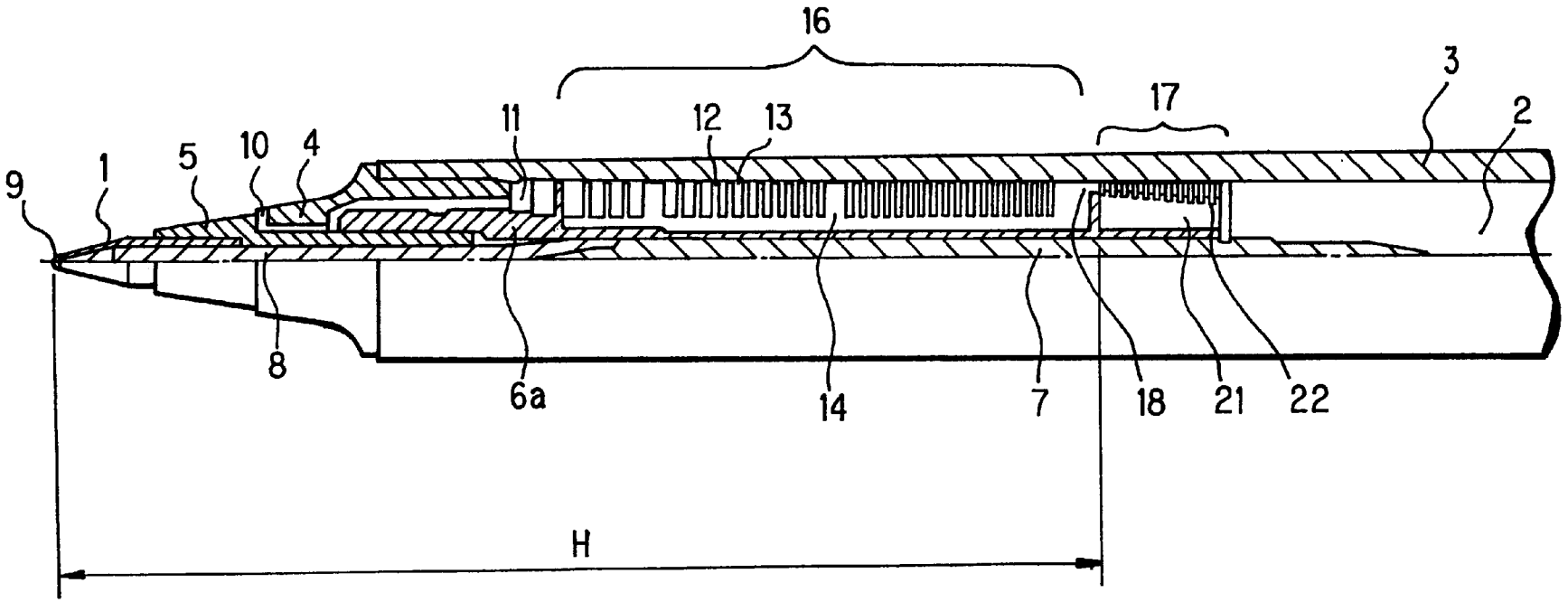
FIG. 1 is a partly sectional vertical view showing a writing instrument according to the first embodiment of the present invention.

As shown in FIG. 1, the writing instrument of the first embodiment of the present invention is a ball-point pen comprised of a point assembly 1 having a ball as a writing point 9 at the tip and an ink feeder portion made up of a center core 8 and a collector core 7 serving as an ink feeder core for establishing the flow passage of ink 2 from an ink tank 3 to writing point 9. Here, examples of the ink feeder core (center core 8, collector core 7 and the like) may include one which itself serves as a pen tip.

As point assembly 1, pen tips of various types of writing instruments can be used as already mentioned. A collector 6*a*, which is composed of vanes 12 defining retaining grooves 13 therebetween and a narrow longitudinal groove 14 for establishing ink communication between an air groove 15 (FIG. 3) connected to the outside and each retaining groove 13, is arranged between cup-like ink tank 3 integrally formed with a bottom and point assembly 1, forming a so-called collector type writing instrument. The collector 6*a* may be the conventionally used, aforementioned one having retaining vanes 12 arranged crosswise, or may be one that uses a fabric sliver etc. In any way, the collector is a part which has the function of adjusting the variations in pressure by temporarily storing ink with the help of the balance of capillary capacity and the function of relatively reducing the pressure inside ink tank 3 by making use of a small-diametric meniscus mechanism at an air/liquid exchanger 18 so as to avoid extra ink head applying to the interior of point assembly 1.

In the collector type writing instrument, free-state ink 2 is stored inside ink tank 3 while air/liquid exchanger 18, which is provided in collector 6*a* and is small enough, is wetted with ink 2, so that ink tank 3 is isolated from the external air and air will not enter ink tank 3 from the outside other than air/liquid exchanger 18.

Generally, collector 6*a* may be subjected to a plasma treatment or a chemical treatment with a mixture of sulfuric acid and chromic acid, or the molding resin may be added and kneaded with, or surface coated with a saponaceous component which is well wettable so that the collector is ready to be wetted with ink 2. Other components such as a plastic mouthpiece 5, joint 4, cap(not shown), ink 2 and the like should not be limited particularly by the present invention, and conventional items can be selected and used as appropriate. Similarly, for ink 2, any ink can be used and selected as appropriate as long as it can be used for collector type writing instruments. Examples include: inks based on water, alcohols, xylene, various glycolic solvents, various etheric solvents and other solvents, inks containing pigments, dyes as coloring agents and inks having some viscosity or pseudo-plasticity.

A collector type writing instrument has a function of preventing leakage of free-state ink from the interior by keeping the balance with the variation in pressure.

When the internal pressure inside ink tank 3 varies, ink 2 may enter retaining grooves 13 of collector 6*a* by way of air/liquid exchanger 18 or air may enter tank 3 by way of air/liquid exchanger 18 so as to keep the balance of the internal pressure, whereby almost no pressure other than the ink head H acts on the interior of point assembly 1 while the meniscus at air/liquid exchanger 18 functions to practically keep the pressure in the ink tank 3 side lower than the external pressure to prevent forward leakage from point assembly 1.

Though it is possible to lower the internal pressure and hence easily prevent ink leakage by making the diameter of air/liquid exchanger 18 smaller, ink flow for writing is also hindered at the same time. Therefore, the width of air/liquid exchanger 18 is typically set at about 0.05 mm to 0.2 mm. Air/liquid exchanger 18 is formed by a groove, hole or a clearance defined by the combination of parts. When the center core and collector core as fiber bundle cores are made up of fabric sliver, gaps between fibers serve as air/liquid exchanger 18.

When the amount of ink 2 in ink tank 3 is reduced by ink consumption for writing to a level slightly greater than the maximum retention of the collector, expansion and contraction of air in ink tank 3 becomes maximum. To deal with, the conventional collector type writing instruments are designed so as not to cause flooding of ink 2 from air hole 10 by filling the collector with ink 2 in case air expansion or contraction inside tank 3 occurs due to increase or decrease in external air pressure or change in temperature. Generally, a correlation between the volume of an ink tank 3 and the maximum ink retention amount i of a collector has been known. Usually, the writing instrument is designed so that the maximum ink retention volume i is about 10 to 30% of the ink tank volume.

It is possible to improve safety margin as to flooding if the proportion of the maximum ink retention volume i to the size of ink tank 3 is increased. However, if the collector is made too long, the ink head H acting on the point assembly 1 becomes too high, posing the forward leakage problem from the point assembly. If the collector is made too large in diameter, the barrel size becomes too thick, causing difficulties in gripping and influence on its external appearance or stylishness. If ink tank 3 is made smaller, the amount of ink decreases, resulting in short writing distance. For these reasons, extra auxiliary retaining grooves 17 are formed in addition to main retaining grooves 16 as shown in FIG. 1 so as to increase the retaining volume of the collector without increase of ink head H.

Figure 2:
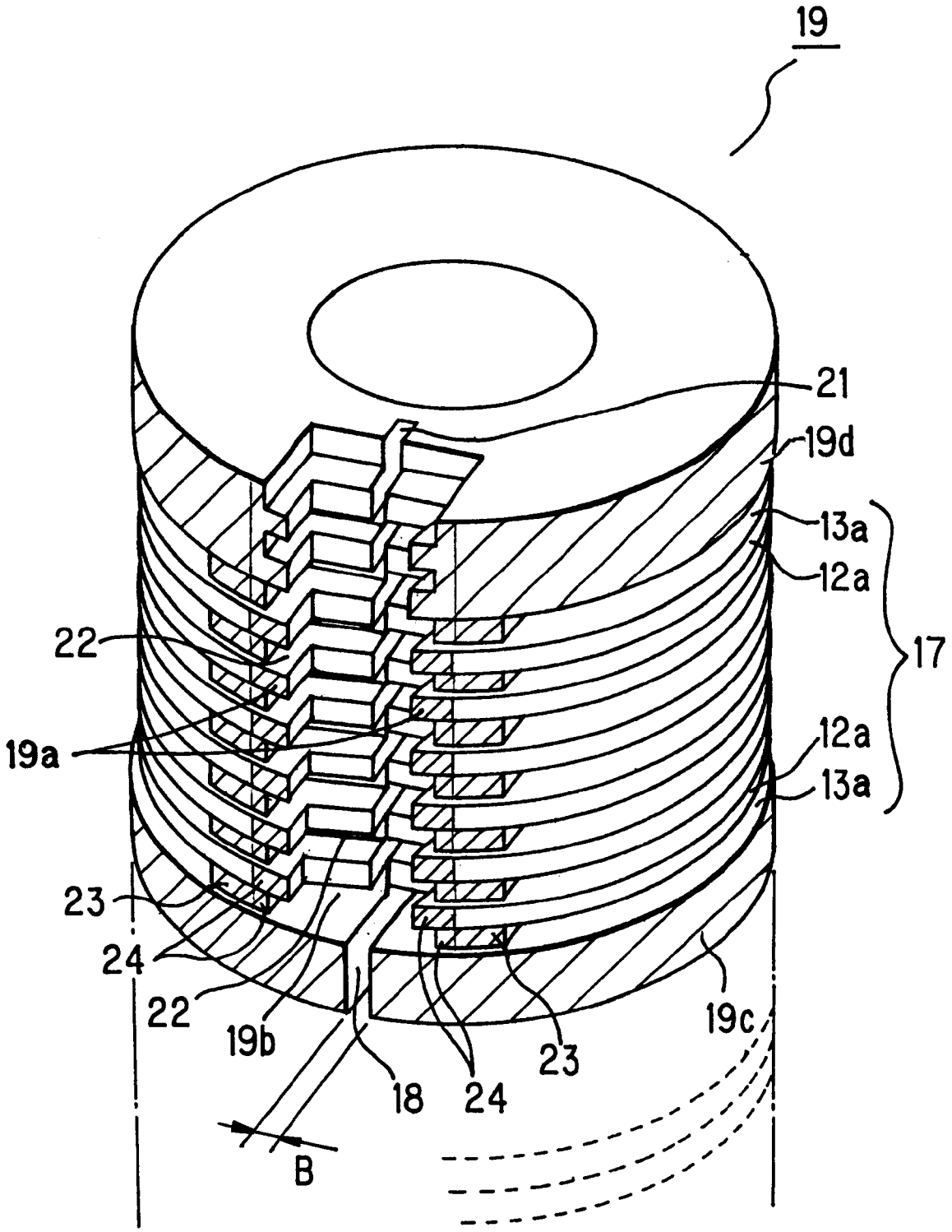
FIG. 2 is a perspective view showing auxiliary retaining grooves 17 of a first example according to the first embodiment of the present invention.

FIG. 2 is a perspective view showing auxiliary retaining grooves 17 (partitioning portion 19).

Partitioning portion 19 is constructed of a frontmost partitioning portion 19*c* formed with air/liquid exchanger 18, a rearmost partitioning portion 19*d* confronting ink tank 3 and extended partitioning portion 19*a* for connection between the frontmost partitioning portion 19*c* and rearmost partitioning portion 19*d*. The part with hatching shown in FIG. 2 (FIG. 17, FIG. 21 and FIG. 22) is wetted with ink 2 and hence shut off from external air. Exchange of air with ink tank 3 is made through air/liquid exchanger 18.

A number of fin-like vanes 12*a* protruding upright like flanges are formed at predetermined intervals on the outer peripheral surface in the range of auxiliary retaining grooves 17 and define retaining grooves 13*a* by the gaps therebetween. In the present embodiment, six vanes 12*a* are provided at regular intervals, constituting auxiliary retaining grooves 17.

Partitioning portion 19 and air/liquid exchanger 18 (groove or hole) is wetted with ink 2 so that the interior of ink tank 3 is substantially shut off from external air. For air replacement during writing, air/liquid exchanger 18 alone serves for air replacement.

Partitioning portion 19 may be formed by a part or combination of parts having no intentional grooves or holes. Alternatively, the partitioning portion may be formed with a part or parts having fine grooves or holes, as long as their dimensions are small enough compared to the dimensions of air/liquid exchanger 18, so that once the parts have got wetted with ink 2 no air replacement will be permitted therethrough or substantial confinement can be assumed to be established.

Formed in the space enclosed by extended partitioning portion 19*a*, rearmost partitioning portion 19*d* and frontmost partitioning portion 19*c* is an enclosed portion 19*b* which constitutes a channel that permits air bubbles entering by air replacement to move from air/liquid exchanger 18 to the ink tank side 3 side.

Enclosed portion 19*b* is formed of a relatively wide groove, cutout or hole for permitting air bubbles arising from air replacement to move to the ink tank 3 side, and preferably has a configuration which is usually filled up with ink 2 when the writing instrument is put with its pen tip down. The enclosed portion 19*b* of the present embodiment is configured so as to form a space which gradually increases its depth in the radial direction of collector 6*a* as it approaches from the air/liquid exchanger 18 side to the ink tank 3 side. This arrangement of enclosed portion 19*b* formed so that the areas of opening become gradually greater from the air/liquid exchanger 18 side to the ink tank 3 side, enables air bubbles arising at air/liquid exchanger 18 to move to the ink tank 3 side more smoothly compared to the configuration where the areas of opening are made uniform.

Further, enclosed portion 19*b* is formed with lateral grooves 22 and a narrow groove 21 which leads ink 2 towards air/liquid exchanger 18.

Since narrow groove 21 provides almost the same functions, i.e., introduction and connection of ink 2, as narrow longitudinal groove 14 connected to main retaining grooves 16 does, it can be formed with dimensions and configuration similar to those of longitudinal groove 14, but may be formed by a cutout or hole defined by combination of parts as long as it can provide the function of leading ink 2 to lateral grooves 22.

Further, in order to lead ink 2 from lateral grooves 22 into retaining grooves 13*a*, partitioning portion grooves 23 having almost the same width as retaining groove 13*a* are formed on the outer peripheral surface of extended partitioning portion 19*a*.

In order to lead ink 2 from narrow groove 21 to partitioning portion grooves 23, lateral grooves 22 for connection between narrow groove 21 and partitioning portion grooves 23 are formed in enclosed portion 19*b*.

Lateral groove 22 may be formed by a groove, cutout, hole, clearance defined by a plurality of parts, or any other structure and shape, which provides the function of creating communication of ink 2 led from the ink tank 3 side via narrow groove 21 to auxiliary retaining grooves 17, as long as it can practically lead ink 2 to auxiliary retaining grooves 17.

Figure 26:
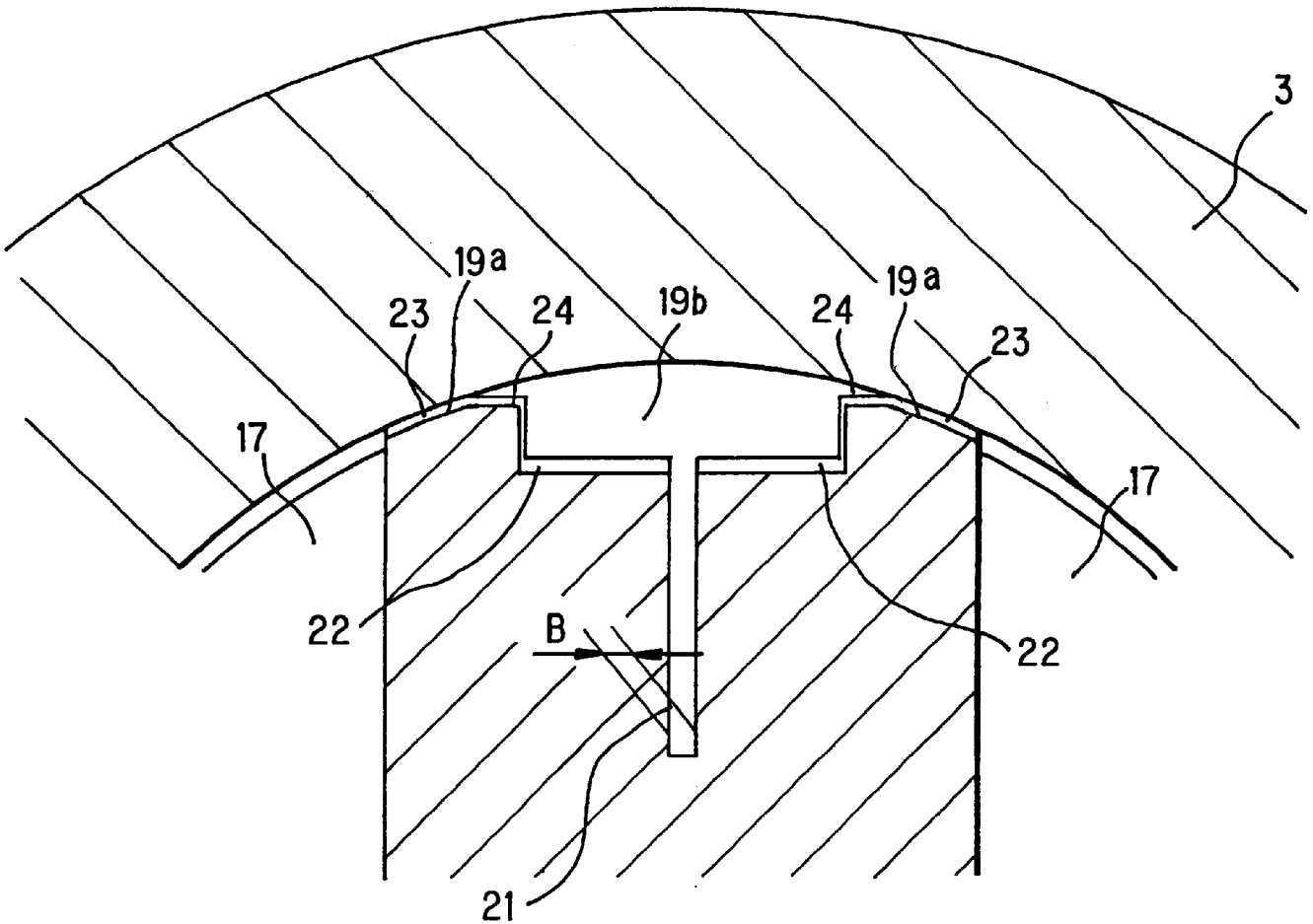
FIG. 26 is a sectional view viewed from the E—E direction in FIG. 24.

Further, in the present embodiment, in order to make ink flow smoothly from the enclosed portion 19*b* side to the auxiliary retaining groove section 17 side, the edges of extended partitioning portion 19*a* are cut off so as to form chamfers 24 (also see FIG. 26).

Chamfers 24 are formed so that the size of the opening becomes smaller as it goes from the enclosed portion 19*b* side to the auxiliary retaining grooves 17 side.

In the present embodiment, the ink head H is the difference in height from air/liquid exchanger 18 to writing point 9 of point assembly 1. That is, the ink head is the same as conventional collector type writing instruments, hence no forward leakage, or ink leakage from writing point 9 will occur. The capacity of adjustment when the air space inside ink tank 3 expands or contracts, namely the maximum ink retention amount i of collector 6*a* is increased by the maximum ink retention amount ie of the auxiliary retaining grooves compared to the conventional configuration. Therefore, the resultant collector type writing instrument is improved in its capability to deal with variation in pressure and change in temperature.

The ink lead and discharge arrangement, aiming at establishing communication between auxiliary retaining grooves 17 of the present invention and ink 2 inside ink tank 3, constituted by narrow groove 21, lateral grooves 22, partitioning portion grooves 23 and the like, enables ink 2 in ink tank 3 to flow into auxiliary retaining grooves 17 at the moment ink flows into main retaining grooves 16 of collector 6*a*, simultaneously if a sharp variation in pressure occurs. In sum, unlike the conventional configuration in which all ink 2 would flow in a rush and flood out by way of only air exchanger 18, ink may also flow into auxiliary retaining grooves 17, thus making it possible to alleviate the rushing flow.

Further, the arrangement of auxiliary retaining grooves 17, lateral grooves 22, partitioning portion grooves 23 and narrow groove 21 assures that ink 2 will flow into auxiliary retaining grooves 17 when a sharp reduction in external air pressure occurs as stated above, whereby it is possible to reduce the amount of ink flowing into main retaining grooves 16 as well as weakening the power of the rushing flow.

Moreover, when a sharp increase in external air pressure occurs, the ink 2 held in auxiliary retaining grooves 17 can return to ink tank 3 owing to the arrangement of auxiliary retaining grooves 17, lateral grooves 22, partitioning portion grooves 23 and narrow groove 21, in an easier manner than ink returns through air/liquid exchanger 18. Therefore, even if increase and decrease in pressure is further repeated, the ink retention volume of collector 6*a* capable of retaining ink 2 can be easily recovered so that it is possible to increase the permissible margin against flooding.

Since partitioning portion 19 has a rather irregular configuration, there are cases where the collector end face may dry when the device is assembled or when it has been set with its tip up for a long period. In such a case, it happens that this part becomes difficult to be wetted with ink 2 immediately. In order to reliably wet this part with ink 2 and practically shut off ink tank 3 from external air, narrow groove 21 for leading ink and lateral grooves 22 and partitioning portion grooves 23 connected to the slit to enable ink to reach auxiliary retaining grooves 17 are provided, whereby the entire partitioning portion 19 gets wetted with ink 2 once narrow groove 21 gets wetted with ink 2.

Figure 3:
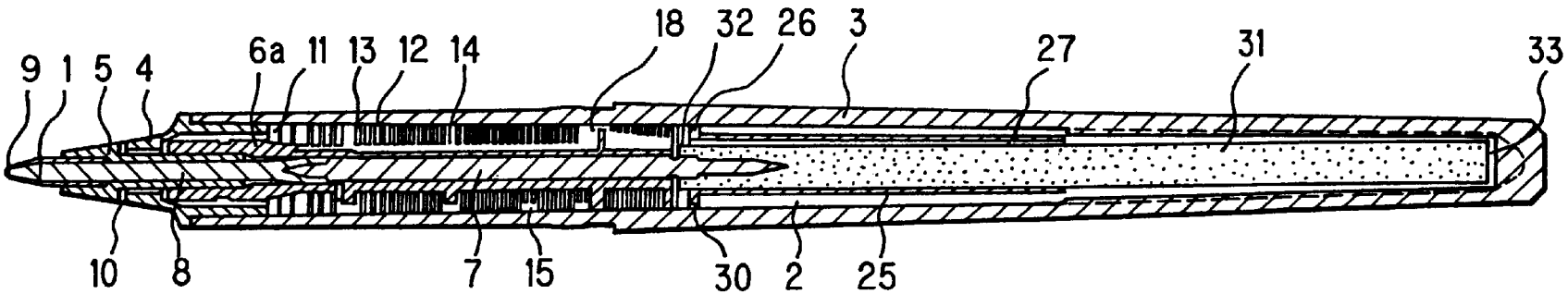
FIG. 3 is a vertical sectional view showing the whole writing instrument of a first example according the first embodiment of the present invention.
Figure 4:
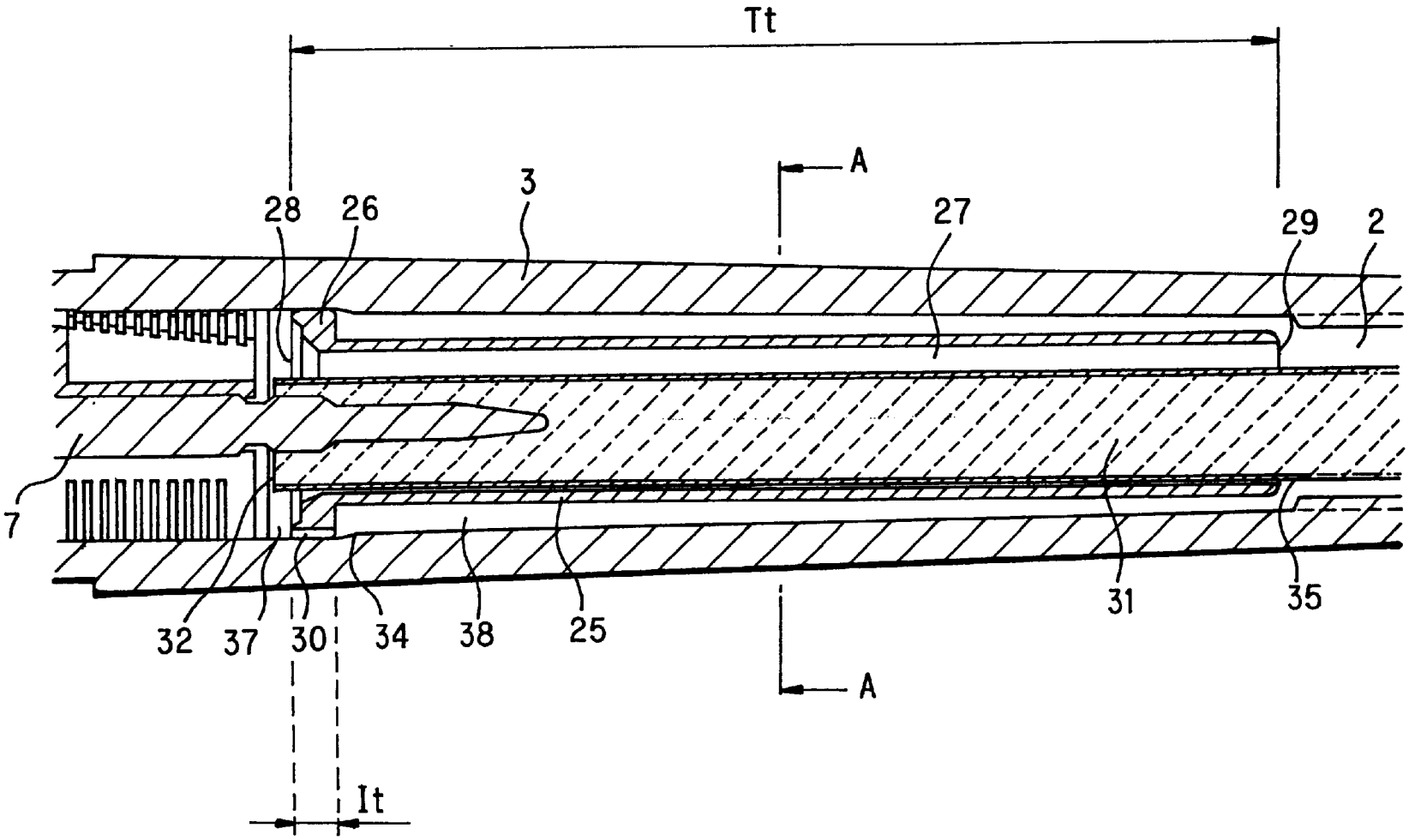
FIG. 4 is an enlarged vertical sectional view showing part of a writing instrument of a first example according to the first embodiment of the present invention.

As an effective configuration in the first embodiment of the present invention, a snorkel 25 is provided, as shown in FIGS. 3 and 4, in order to release the air at the top space so as to suppress ink 2 from flowing out from tank 3 to as little as possible if air at the top space(in the rear part of ink tank 3) expands when point assembly 1 is set downwards.

Snorkel 25 is composed of a sectioning portion 26 for separating ink tank 3 and a vent portion 27 forming a tubular air path so as to establish air communication between a front opening 28 arranged at the rear end side of collector 6 and a rear opening 29 arranged at the approximate center of, or at a position more rearward than, ink tank 3, as shown in FIG. 4.

When rear opening 29 of snorkel 25 is arranged at the approximate center of the portion where free-state ink 2 is stored (at around the centroid of the portion where ink is stored if an asymmetrical tank is used) in ink tank 3, this provides the optimal configuration when taking the balance between the prevention against flooding when the tool is set downward and the mobility of air bubbles arising during writing.

Sectioning portion 26 is press fitted against the inner wall of ink tank 3 so as to practically separate ink tank 3 into a front tank 37 and rear tank 38. Sectioning portion 26 is formed with a single ink conduit 30 which is formed of a groove or hole sufficiently small compared to the size of vent portion 27(see FIGS. 3 and 4).

Figure 27:
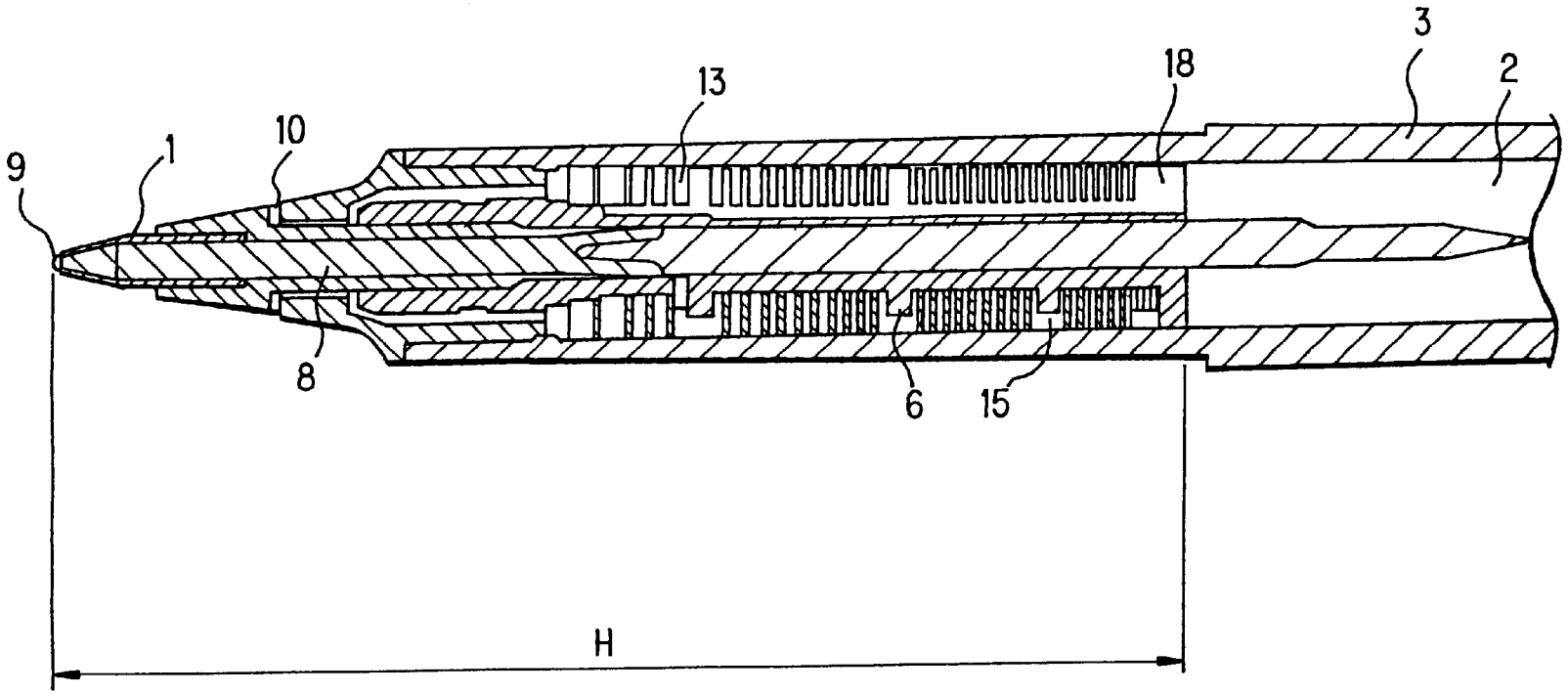
FIG. 27 PRIOR ART
FIG. 27 illustrative view showing the vertical section of part of a conventional writing instrument.

With the above configuration, when the device with a reduced amount of ink is set with its point assembly 1 down, ink 2 in ink tank 3 is able to move from the rear tank 38 side divided by sectioning portion 26 to the front tank 37 side byway of ink conduit 30. That is, ink tank 3 is separated by sectioning portion 26, however, these sections are actually not isolated from each other because of the presence of ink conduit 30. Therefore, this arrangement permits continuous writing as well as allowing ink 2 to move into the collector 6*a* side. It was confirmed from a prototype test that ink 2 could move to the front tank 37 side during writing. Thus, provision of snorkel 25 enables collector 6*a* to exhibit sufficient ink retaining capability when the air pressure and temperature change in a moderate manner. The collector with which the effect of snorkel 25 of the present invention can be achieved should not be particularly limited. The same effect can be obtained if the snorkel is applied to the conventional collector 6 shown in FIG. 27.

For use in an airplane or when the device is carried between low temperature and high temperature environments, the pen is sealed with the cap in order to prevent evaporation of ink 2 inside. Taking an example of use in an airplane, the pen is usually used on the ground under a pressure of about 1 atm. and is capped in a state where the pressure inside ink tank 3 has been stabilized in correspondence with the 1 atm. environment, so that the internal pressure is maintained at that level. After the user boards an airplane, the user first opens the cap and uses the writing instrument under a reduced pressure, at about 0.8 atm. At this moment, the internal pressure of the writing instrument, which has been stabilized at approximately the 1 atm. state, is abruptly exposed to a 0.8 atm. Therefore, since the internal pressure in ink tank 3 is relatively higher than the pressure inside an airplane, in the case of the conventional collector type writing instrument, ink 2 floods in rush into collector 6 via air/liquid exchanger channel 18.

In the arrangement of the present invention, the air inside tank 3 in which the internal pressure is relatively high can be released preferentially to the collector 6 or 6*a* side by means of vent portion 27. Ink 2 around the front tank 37 also flows in at the same time, but the amount is sufficiently small so that it is possible to prevent flooding. Because, in a usual usage the same amount of air as that of ink 2 flowing out for writing will enter the ink tank 3 side, as air bubbles, through air/liquid exchanger 18, and because when capped the writing instrument is held in a pocket with its tip up or kept laterally in a bag, front tank 37 is, in most cases, empty state (space), without ink. Thus, the writing instrument is constructed so that almost no ink 2 flows into the collector 6 side or ink is unlikely to flood when a sharp increase or reduction in pressure occurs.

If an abrupt movement of ink 2 or air inside the writing instrument occurs, ink 2 is blocked by sectioning portion 26 so that ink cannot directly reach collector 6*a*. When there is a large enough difference in resistance against flow between vent portion 27 and ink conduit 30 which is smaller in size than the vent portion 27, the more abrupt the flow of ink 2 or air occurs, the fluid flow is greater in the direction in which it is most liable to flow. When flow of ink or air through a passage of an identical size is considered, air can flow much more easily through the passage. That is, when an abrupt change occurs air can flow through vent portion 27 that opens to the space. In this case, air receives much less passage resistance compared to the passage resistance against ink 2 that flows through ink conduit 30 when the writing instrument is set downward and hence the conduit is wetted with ink 2. As a result, mostly only air will flow to the collector 6 side when a sharp increase or decrease in pressure occurs.

As the second feature of this embodiment, an absorber 31 capable of retaining ink is disposed together with the above-described snorkel 25. Providing ink absorber 31 inside ink tank 3 has the effect on reducing the volume of the space (to be referred to hereinbelow as 'volume reduction effect') without reducing the amount of ink 2 when the space grows in ink tank 3 as ink 2 is consumed.

As above, the amount of expansion of the space itself is reduced so as to weaken the power of flooding, whereby it is possible to reduce the amount of ink flowing into the collector 6*a* side.

As a practical arrangement, ink absorber 31 made up of fabric sliver or the like is arranged so as not to block vent portion 27 of snorkel 25. In order to make the volume reduction effect of ink absorber 31 more effective, the ink absorber preferably has a length which reaches to the approximate center of ink tank 3 or extended to further rear.

When ink absorber 31 is keeping ink 2, the absorber occupies the rear space without reducing the amount of charge of ink 2 in ink tank 3, whereby it is possible to substantially reduce the expansion of air when an increase or reduction in pressure occurs.

Further, in order to take advantage of one of the benefits of free-ink type writing instruments, that is, the feature that the amount of ink left in ink tank 3 can be viewed from the outside, it is necessary for ink 2 to freely enter or leave at least a sector formed around ink absorber 31.

Combination of the above feature with the constituents of the first feature of the present invention provides for a combined and enhanced effect that is greater than the sum of their individual effects.

Figure 5:
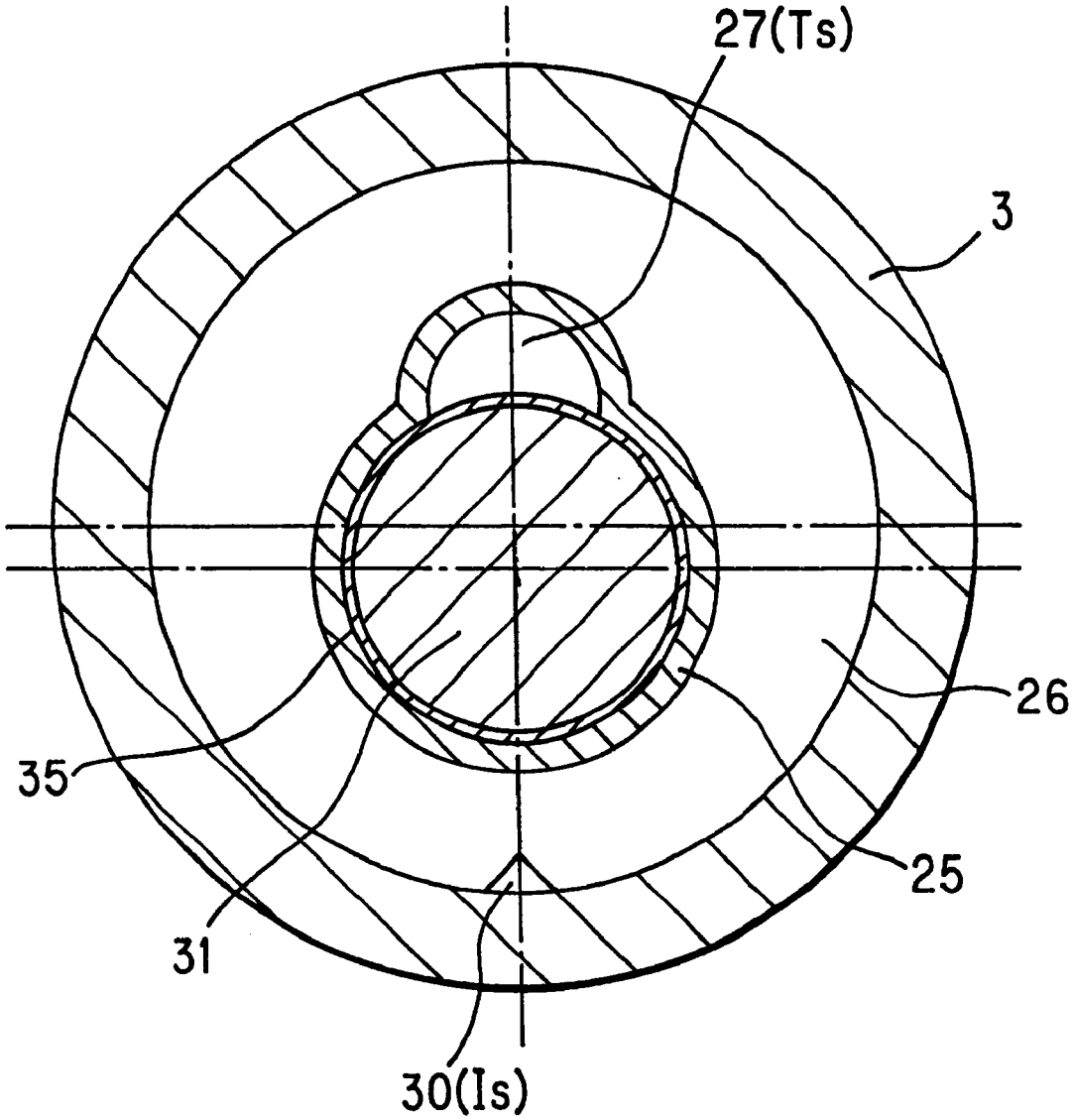
FIG. 5 is a cross-section cut along A—A in FIG. 4.

As the third feature of the first embodiment, ink absorber 31 is formed with an unabsorbent cladding 35 so as to allow only the front and rear ends, i.e., front and rear absorptive portions to absorb ink 2 while vent portion 27 is defined by an asymmetrical snorkel 25 as shown in FIG. 5, in combination with ink absorber 31. Though this snorkel 25 by itself will not form an optimal shape for vent portion 27, it can create a shape providing the necessary function when combined with other parts (ink absorber 31 in this case). As a result unnecessary walls etc. can be omitted.

In the present invention, it is necessary to add extra parts such as snorkel 25, ink absorber 31 and the like, which decrease the capacity of ink tank 3, compared to the conventional configuration. Since it is necessary to decrease the amount of ink 2 or enlarge ink tank 3, by the increased volume due to addition of these parts,these parts need to be configured as small as possible. In the first example of the present invention, in order to suppress the increase in volume of these elements, the writing instrument was formed so as to have a sectional configuration as shown in FIG. 5. In this embodiment, since the increment was about 0.2 $mm^3$ (cubic millimeters), the volume increment could be compensated by increasing the ink tank 3 in inside diameter or making it longer while the outside diameter of the writing instrument was unchanged as before.

Sectioning portion 26 may be formed integrally with snorkel 25 and by press fitting the integral structure against inner wall 34 of the ink tank as mentioned above, or sectioning portion 26 may be formed by providing a wall protruding from inner wall 34 of the ink tank and pressing fitting a cylindrical snorkel 25 thereinto. Alternatively, sectioning portion 26 may be formed as a separate part independent of snorkel 25 and ink tank inner wall 34.

Figure 6:
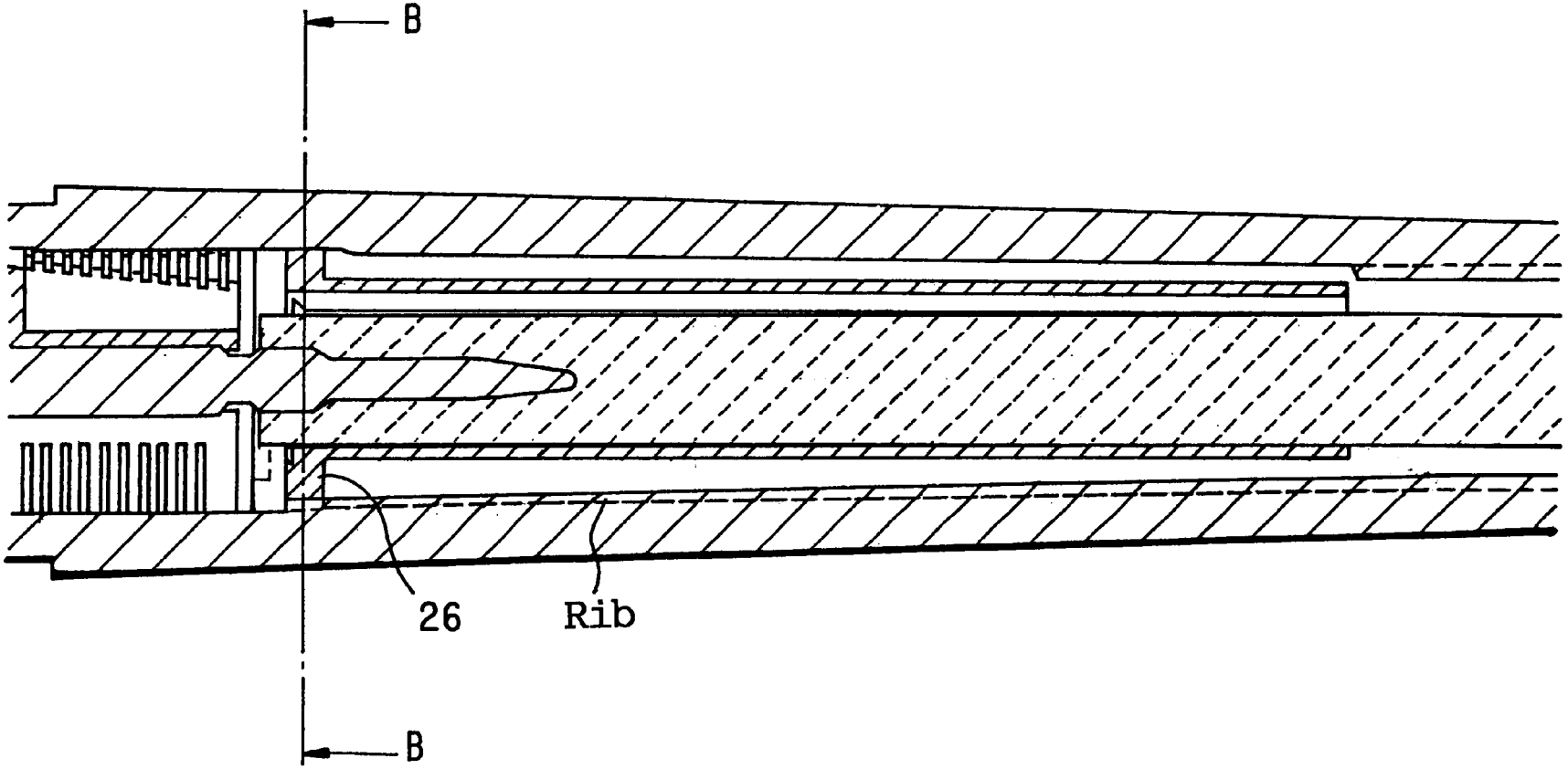
FIG. 6 is an enlarged vertical sectional view showing part of a writing instrument according to the first embodiment of the present invention.
Figure 7:
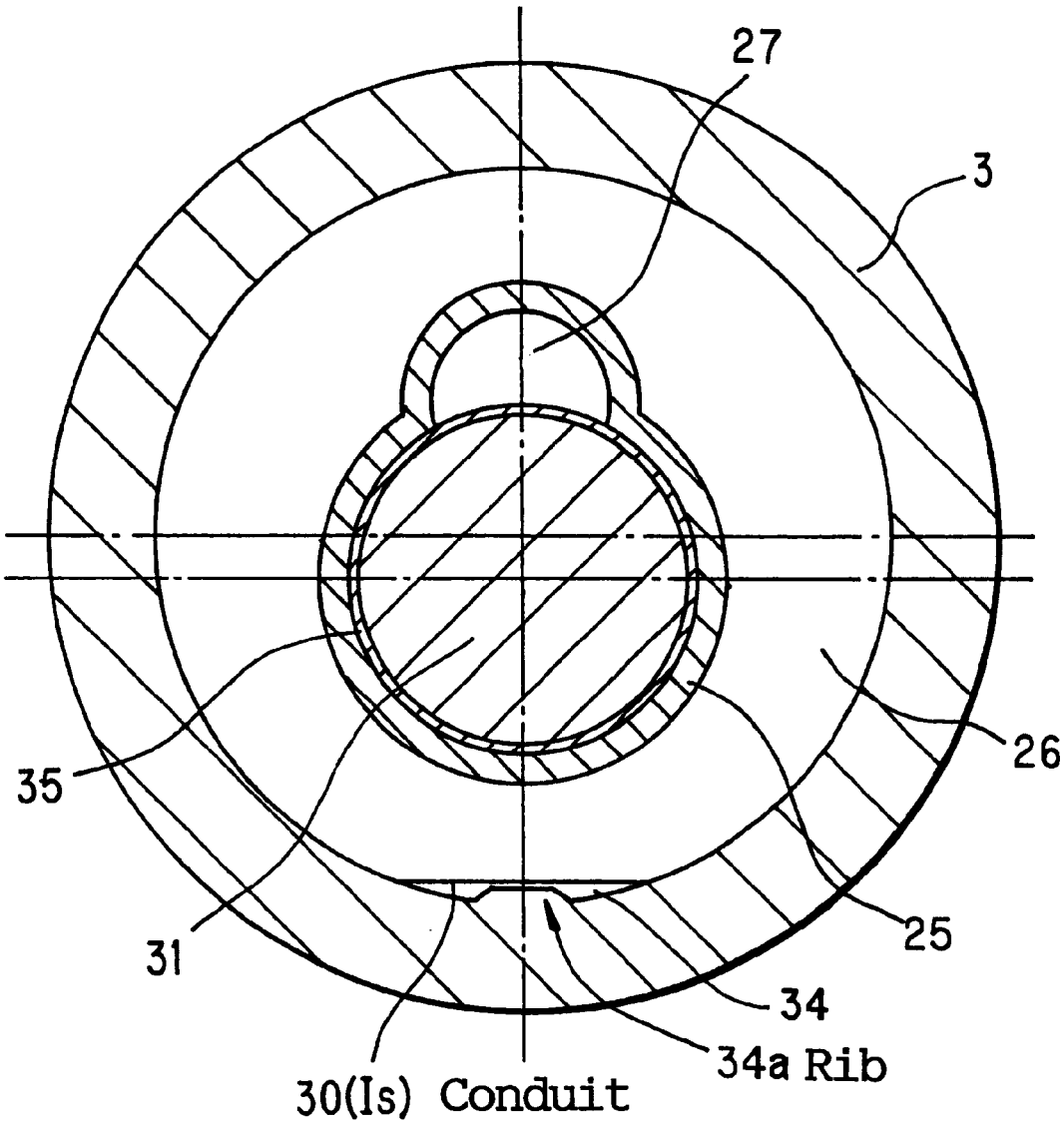
FIG. 7 is a cross-section cut along B—B in FIG. 6.

Further, conduit 30 may also be formed by the combination of snorkel 25, sectioning portion 26 and ink tank inner wall 34. For example, as shown in FIGS. 6 and 7, a rib 34*a* having a trapezoidal cross-section may be formed from ink tank inner wall 34 while sectioning portion 26 may be formed with a cutout at a position corresponding to rib 34*a* so as to create a conduit defined with rib 34*a*. The conduit 30 in FIG. 10 is depicted in an exaggerated manner for easy viewing.

Figure 8:
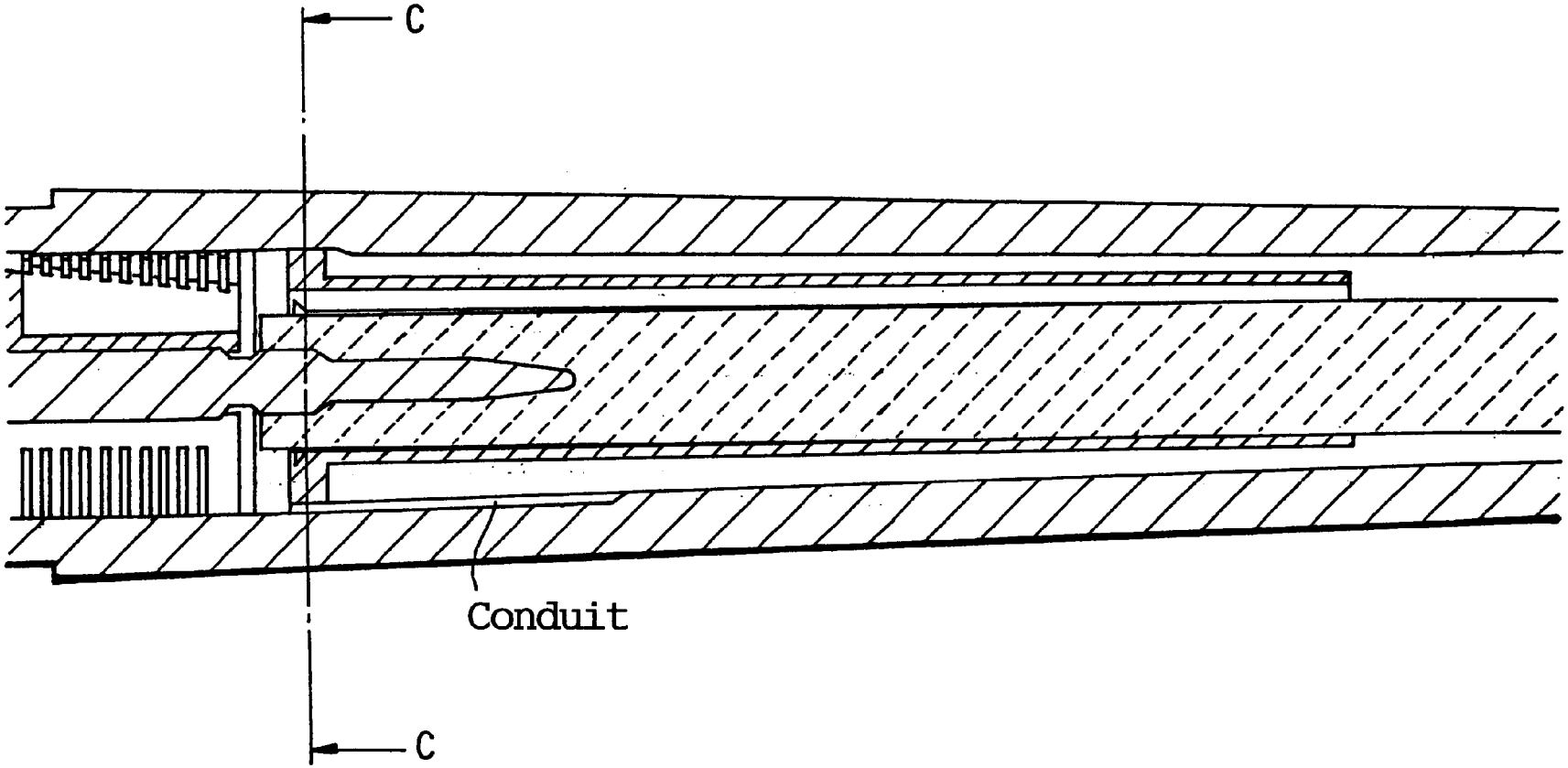
FIG. 8 is an enlarged vertical sectional view showing part of a writing instrument according to the first embodiment of the present invention.
Figure 9:
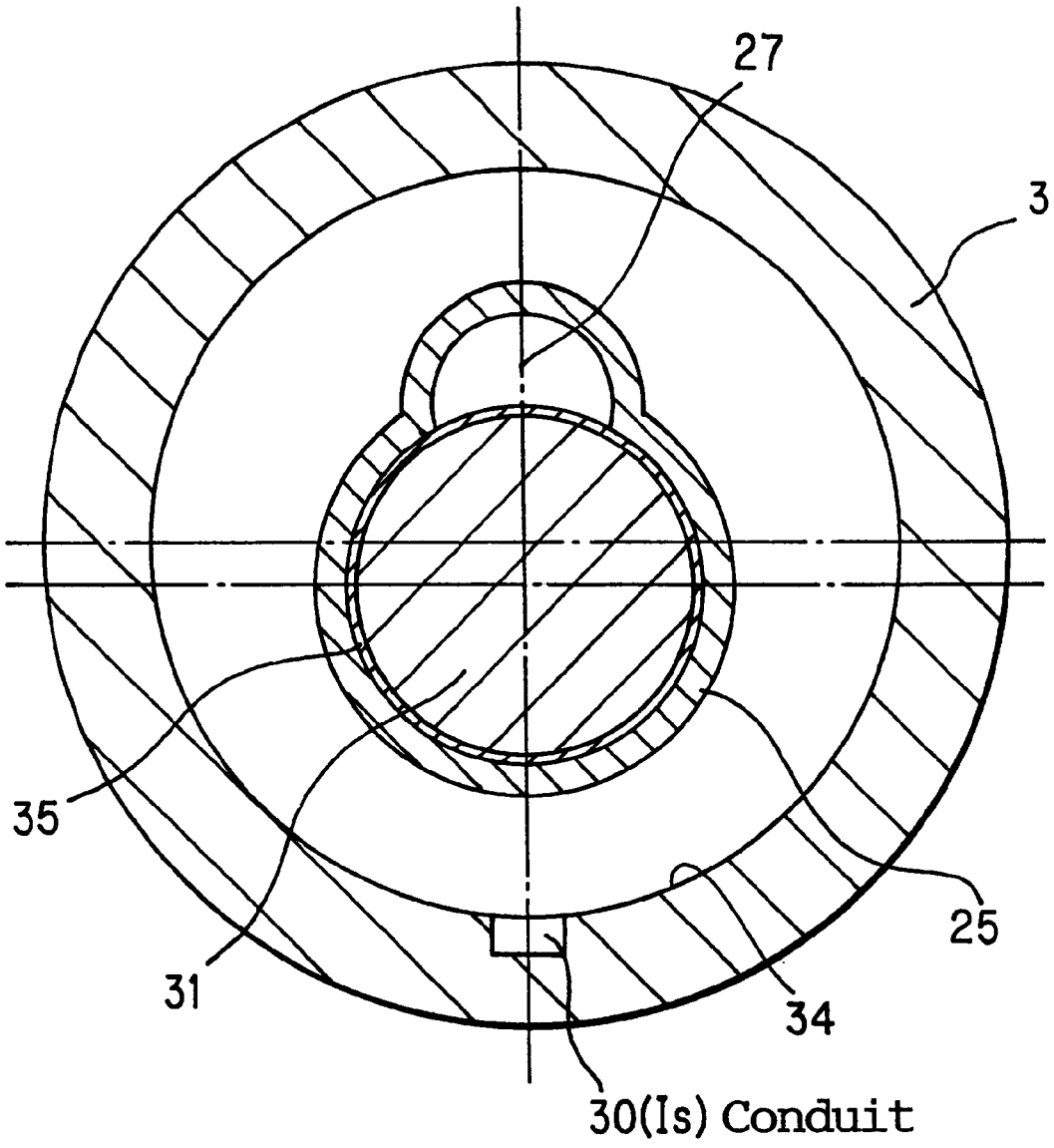
FIG. 9 is a cross-section cut along C—C in FIG. 8.

It is also possible to form a conduit 30 on the ink tank inner wall 34 side as shown in FIGS. 8 and 9. Further, the number of conduits 30 should not be limited. Conduits 30 may be formed at a plurality of sites on the ink tank inner wall 34 side (FIG. 10) or on the sectioning portion 26 side. Alternatively, the conduit may be provided by combination of the above-described configurations. The cross-sectional shape of conduit 30 should also not be limited particularly.

Snorkel 25 may be formed with unnecessary parts further removed as long as it meets the configuration of the present invention. Ink tank 3 may usually employ materials which can inhibit evaporation of ink 2, for example, transparent polypropylene (PP) and the like when ink is of a water-based one. Snorkel 25 of the present invention can be formed of transparent or opaque material having resistance to ink, such as PP, ABS, PET, PE and others, selected as appropriate, depending on its purpose.

FIGS. 11 and 12 show a second example of the first embodiment.

The difference from the first example resides in the configuration of snorkel 25. First, three vent portions 27 are provided, whereby air can be easily ventilated in any direction when the writing instrument is placed with its point assembly down, but as long as it is set within a certain range of angle it needs not be so exactly set downwards. Further, ink conduits 30 are formed at five sites in sectioning portion 26. Further, connection grooves 36 are formed from the center of sectioning portion 26 to each ink conduit 30 so that ink 2 can readily flow to the front tank 37 side while ink 2 is unlikely to be left over within rear tank 38.

FIG. 13 shows a third example of the first embodiment.

The difference from the second example resides in that vent portions 27 are not formed in combination with ink absorber 31 but are provided in a pipe-like form, integrally with (or separated from) sectioning portion 26. The arrangement of this example, in which the ventilating means is provided in a separated form, not built on the part combination with ink absorber 31 or other components, also makes it possible to provide the effects of the present invention. When increase in volume of ink tank 3 is permitted, this configuration may be adopted.

FIGS. 14 and 15 show a fourth example of the first embodiment.

The difference from the above example resides in that a beveled portion C1 or C2 is formed at the rear opening of snorkel 25. Provision of beveled portion C1 or C2 makes it possible for air bubbles to readily depart from the rear opening. This configuration prevents air bubbles from congesting in the vent portion 27 causing adverse effects on writing performance or other problems.

Beveled portion C1 of snorkel 25 shown in FIG. 14 is formed by beveling the end part of snorkel 25 inwardly to the center of ink tank 3 across the predetermined length P1 from rear opening 29 so as to create a flat rear opening 29*a* having a greater opening area than that of rear opening 29.

Beveled portion C2 of snorkel 25 shown in FIG. 15 is formed by beveling across a length P2, which is shorter than that of beveled portion C1 shown in FIG. 14, at the same inclination, forming an angled rear opening 29*b* having a greater opening area than that of rear opening 29.

The shape of the beveled portion of snorkel 25 should not be limited to the above configurations.

The Operation of the First Embodiment

The functions of the first to fourth examples will be described next.

The arrangement of the present invention not only provides the same function of conventional collector type writing instruments, i.e., prevention against ink flooding when the internal pressure varies in a relatively gentle manner with change in temperature, but also provides the function of preventing ink from abruptly entering the collector from the ink tank side, by releasing air from the tank when an abrupt change in pressure occurs, in consideration of use on an airplane. Further, since air is released, the power of ink flushing can be weakened if ink flows out and it is also possible to solve the problem of ink accumulating within the collector due to use under conditions in which increase and reduction in pressure is repeated. Thus, this configuration is able to totally prevent accidents of collector type writing instruments, including flooding and forward leakage.

The arrangement in combination with the ink absorber provides a combined enhanced effect of the function of the invention for releasing expanded air to the outside of the writing instrument as much as possible and the volume reduction effect of the ink absorber, whereby it is possible to provide a writing instrument with which the problem of flooding will almost never occur.

Further, because of provision of the ink absorber, the ink drop problem which would occur when the writing point have been kept upward can be resolved. Because of presence of ink absorber 31, the writing instrument can deliver ink, though in a reduced amount, for approximately the last 100 meters of the writing life similarly to the fabric sliver type one. Therefore, it is possible to solve the end of writing life problem with free-ink type writing instruments or avoid the writing instrument abruptly stopping writing.

Illustratively, in addition to improvement of the collector's adjustment capability as to internal pressure for moderate variation by provision of the auxiliary retaining grooves, the configuration of the present invention makes adjustment against sharp change in internal pressure and provides the function of eliminating the occurrence of flooding and forward leakage in any possible usage situation of writing instruments.

With consumption of ink from writing, air bubbles go up through vent portion 27 and are released from rear opening 29 into ink tank 3. Upon this, air bubbles easily depart from the rear opening owing to provision of beveled portion C1 or C2. Thereby it is possible to prevent air bubbles from congesting in vent portion 27 and causing an adverse effect on writing performance.

According to the first embodiment described heretofore, it is possible to provide a writing instrument which is slim and stylish and excellent in cost performance. It is also possible to suppress the occurrence of pumping phenomena resulting from capping, usage under varying pressure in an airplane and usage in an environment with change in temperature and hence secure safe and stable writing performance. In particular, it is possible to provide a writing instrument free from flooding and forward leakage problems which would have occurred under conditions in which increase and reduction in pressure was repeated, such as in an airplane, as experienced by a businessperson who writes while traveling and who takes multiple flights.

Further, by the combination with the ink absorber, it is not only possible to improve the safety margin but also solve the ink drop problem and the end of writing life problem at the same time. Thus, this configuration has effective functions as described heretofore compared to conventional configurations and hence contributes to providing a safe collector type writing instrument which is stylish and low in cost, can be easily manufactured and has a long shelf life.

The Second Embodiment

Next, the second embodiment will be detailed with reference to the drawings.

Figure 18:
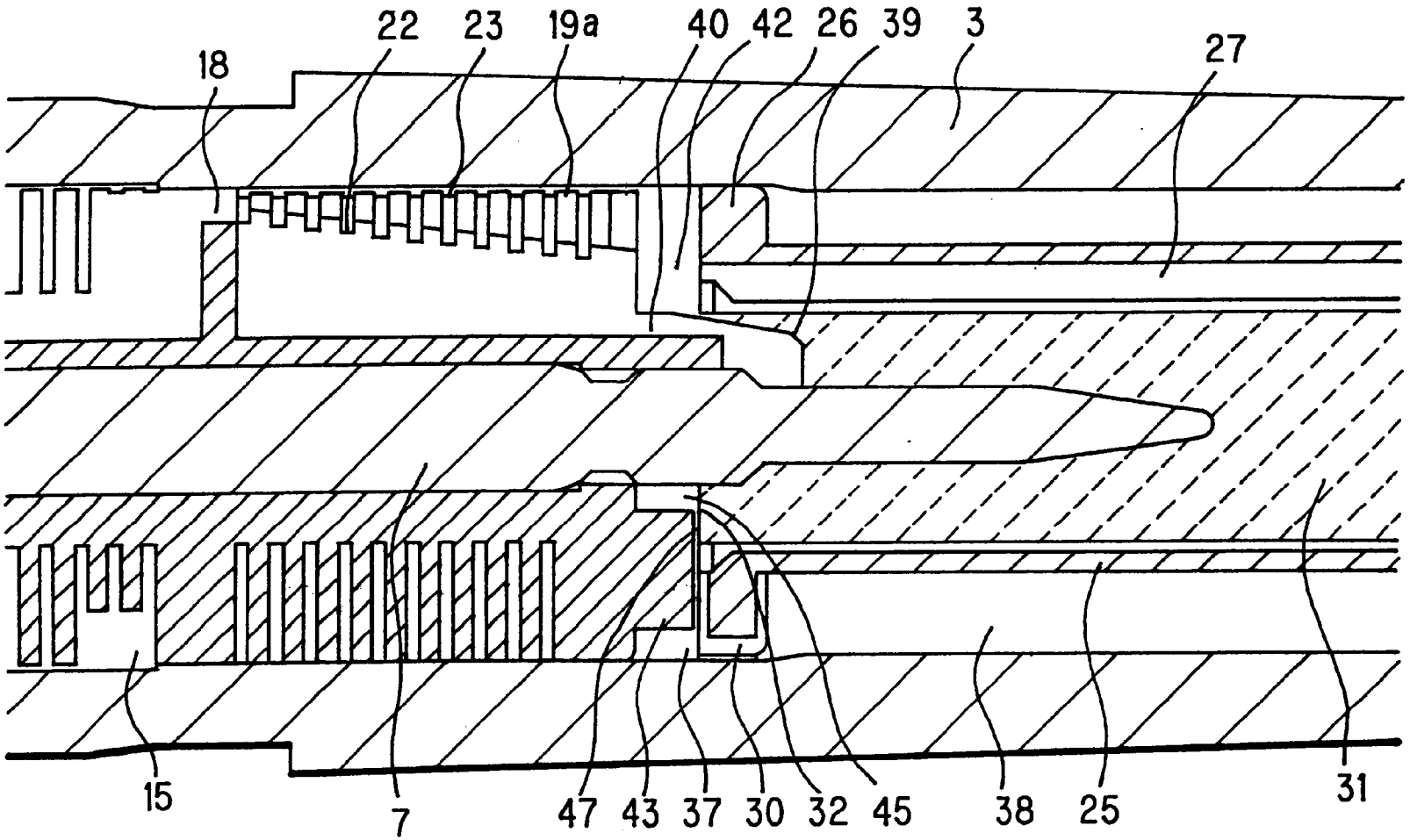
FIG. 18 is an enlarged vertical sectional view showing part of a writing instrument of a first example according to the second embodiment of the present invention.
Figure 19:
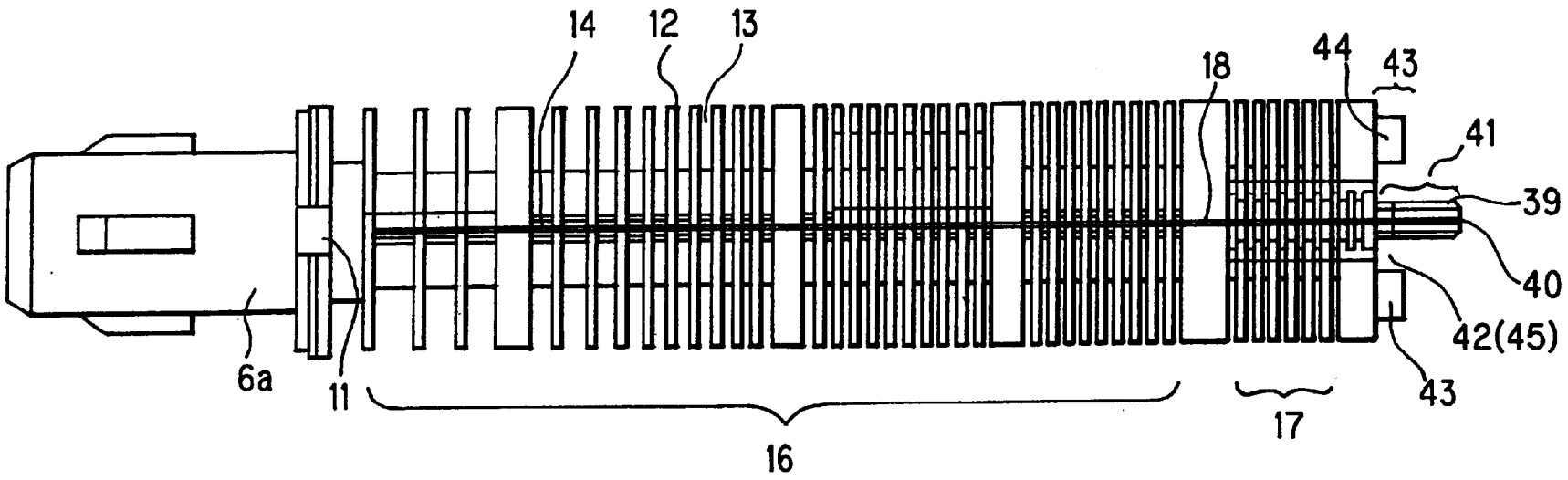
FIG. 19 is a front view showing a collector according to a first example of the second embodiment of the present invention.
Figure 20:
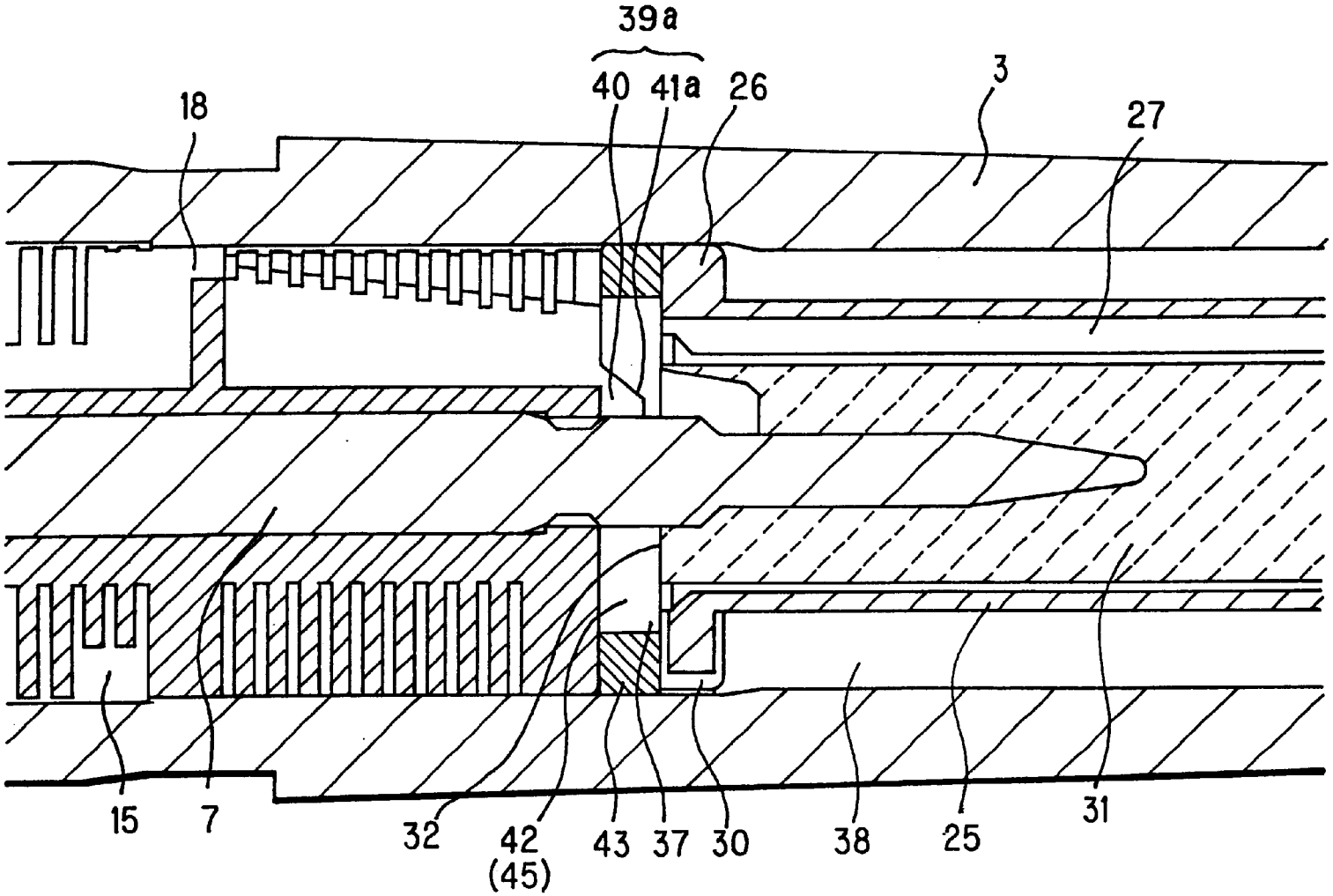
FIG. 20 is an enlarged vertical sectional view showing part of a writing instrument of a second example according to the second embodiment of the present invention.
Figure 21:
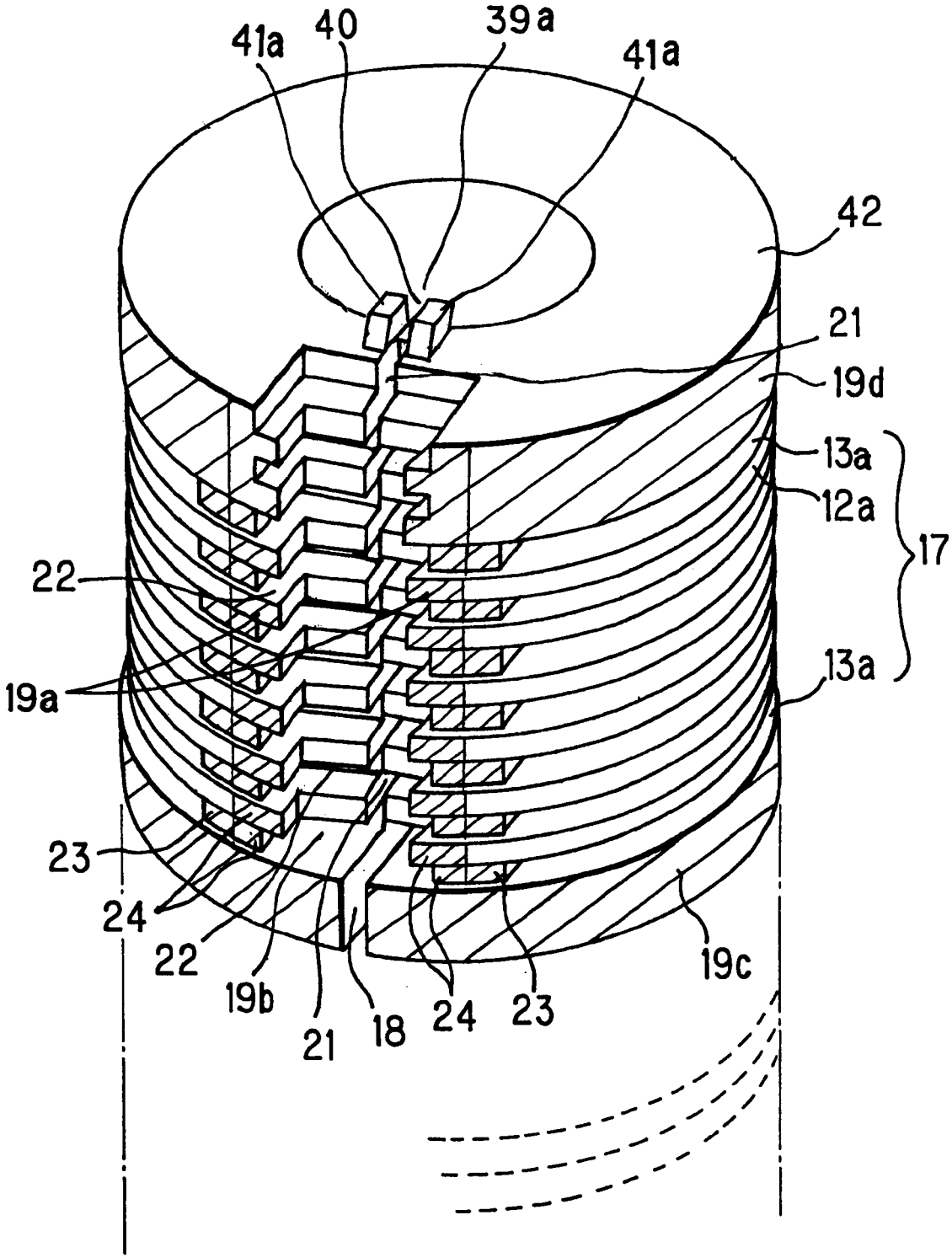
FIG. 21 is a perspective view showing auxiliary retaining grooves 17 of a collector of a writing instrument according to a second example of the present invention.
Figure 22:
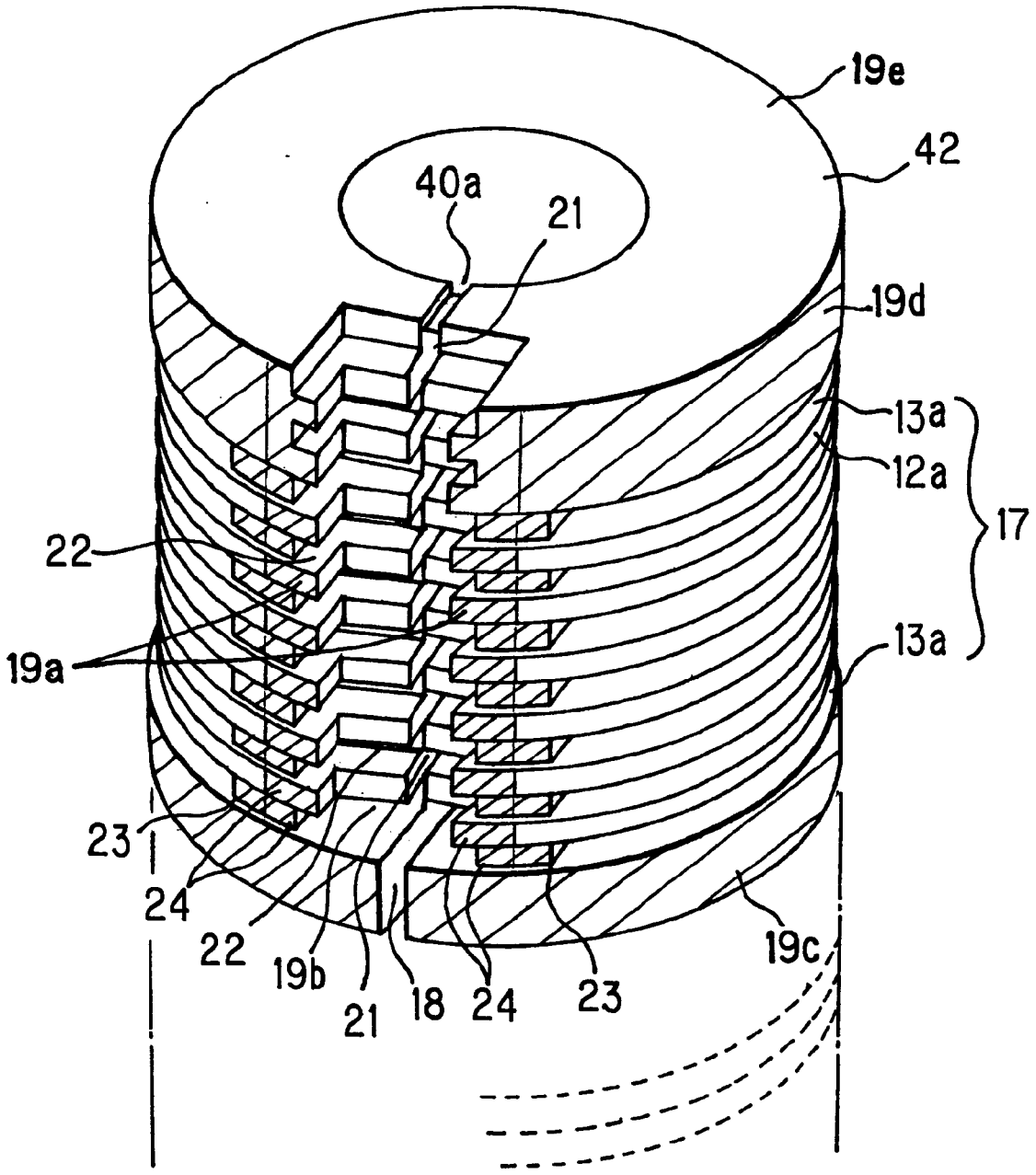
FIG. 22 is a perspective view showing auxiliary retaining grooves 17 of a collector of a writing instrument according to another example of the present invention.

FIGS. 16 to 22 show the configurations of the present embodiment. FIGS. 16 to 19 show a first example of this embodiment, FIGS. 20 and 21 show a second example of this embodiment and FIG. 22 shows another example.

The means featured in the present invention is provision of a spacer portion 43. Specifically, in this embodiment, snorkel 25 and ink absorber 31 and other parts are arranged inside ink tank 3. If conventionally used sponge and other parts are disposed simply on the top of collector 6*a*, air bubbles arising upon air/liquid exchange cannot permeate hence writing unevenness may occur. As the means for prevention against this problem, spacer portion 43 is provided.

In the present embodiment, spacer portion 43 is integrally formed on the rear end of collector 6*a* so that air bubbles from air/liquid exchanger 18 can smoothly pass through vent portion 27 of snorkel 25 to reach the rear part of ink tank 3.

The spacer portion 43 is formed at limited sites on the rear end of collector 6*a* (FIGS. 17 to 19) with an air bubble passage channel 45 (FIGS. 17 to 19) formed so as to assure a clearance portion 42 (FIGS. 17 to 19) that permits air bubbles to move.

Further, spacer portion 43 has an abutment 47 (FIG. 18) on which the front of ink absorber 31 is abutted, whereby ink absorber 31 can be prevented from moving forwards.

Spacer portion 43 should have a size just large enough to allow air bubbles to pass, but if it is too large, the length of ink absorber 31 becomes short, ink 2 becomes unlikely to flow into the front tank 37 side during writing, and other problems may occur. If it is too small in size, air bubbles cannot pass therethrough. Air/liquid exchanger 18 of a typical collector type writing instrument has a vertical slit-like groove having a width ranging from about 0.05 mm to 0.25 mm, and air bubbles arising therefrom are greater than the size of air/liquid exchanger 18 but are at most about 1.5 mm in diameter and usually about 1 mm. Accordingly, the size of clearance portion 42 is preferably set at about 1 mm to 3 mm.

Figure 17:
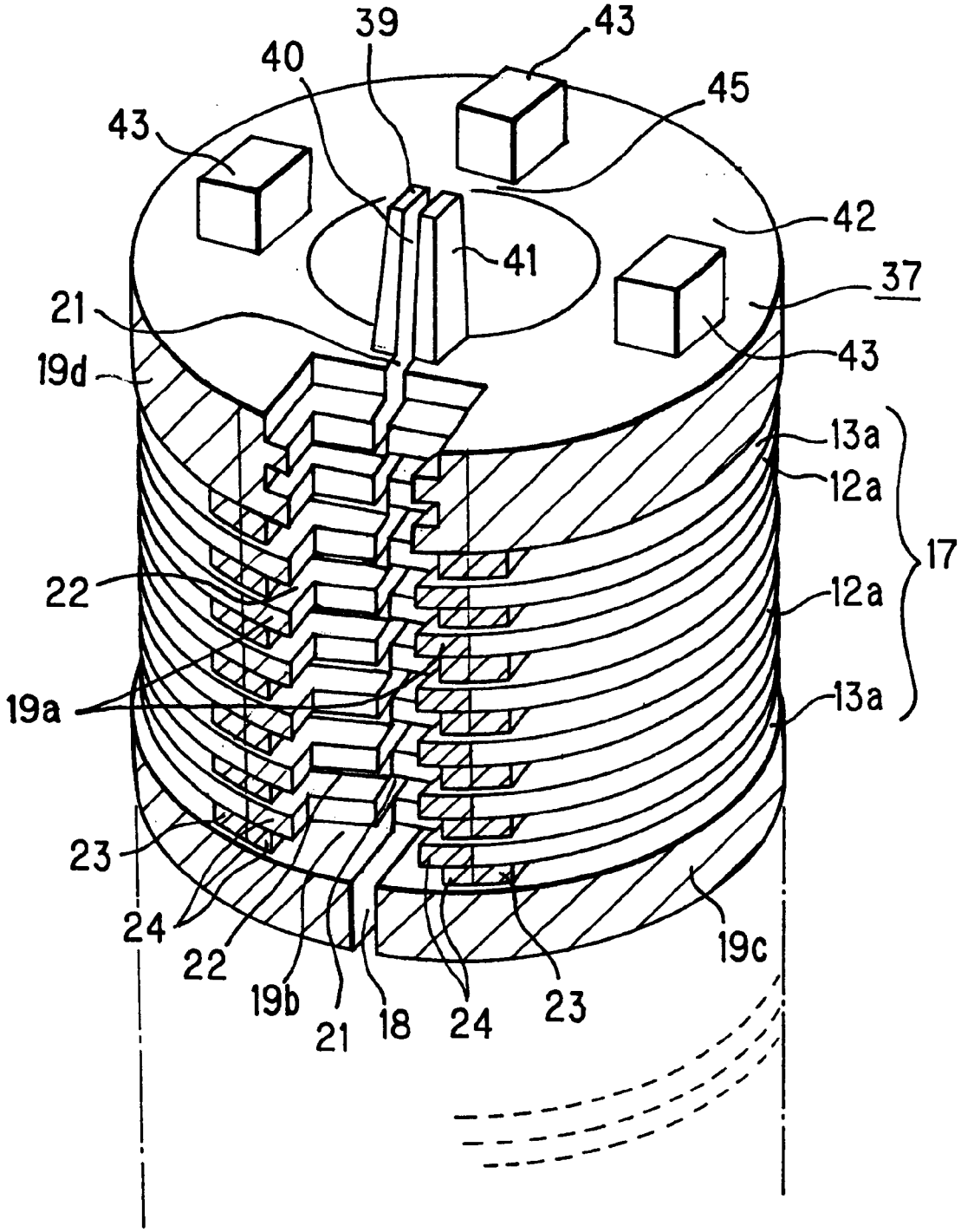
FIG. 17 is a perspective view showing auxiliary retaining grooves 17 of a collector of a writing instrument according to a first example of the present invention.

Further, a lead portion 39 is formed projectively and integrally with collector 6*a* in rearmost partitioning portion 19*d* while horned projections 41 defining a lead channel 40 contiguous to narrow groove 21 are formed so as to be inserted into the front end part of ink absorber 31 (FIGS. 17 and 18).

Provision of projections 41 makes it possible for ink 2 in ink absorber 31 to flow into air/liquid exchanger 18 of collector 6*a* even if point assembly 1 is set downward when free-state ink 2 inside ink tank 3 is used up and when ink 2 is stored virtually to fully 100% in ink absorber 31. As a result, a meniscus can be formed at air/liquid exchanger 18, whereby it is possible to prevent forward leakage because the ink head acting on point assembly 1 can be equalized to the ink head H acting when free-state ink 2 is stored.

FIGS. 20 and 21 show the second example according to the second embodiment.

The difference from the first example resides in that spacer portion 43 is formed as a separate part and is different in the shape of its projections and usage.

There is no significant difference in basic function from the first example, but since spacer portion 43 is given as a separate part, it is possible to produce variations in appearance by forming it as a transparent part or in an ink color.

In general, collector 6*a* is reformed by a plasma or chemical treatment so that its surface is liable to get wetted, but because spacer portion 43 is given as a separate part from collector 6*a*, it can be formed of fluoro-plastics, polypropylene and other materials which are unlikely to get wetted with ink 2 or it can be surface-treated with a Teflon coating or the like. That is, this configuration is advantageous when collector 6*a* needs to be separated from a functional reason or in using conventional collector parts.

Spacer portion 43 may be formed separately but can also be integrally formed with the front end part of snorkel 25 or rear end part of collector 6*a*. In this case, it is possible to reduce the number of parts and hence simplify the assembly and other work.

In the present invention, two parts, ink absorber 31 and snorkel 25, are incorporated in ink tank 3. Such contents entail a high risk of being moved upon being dropped. Provision of ribs etc., in ink tank 3 is able to stop their backward movement, but is inefficient against forward movement. This can be avoided if the parts are firmly fixed so as not to move forwards. However, in general, the parts are formed by molding of a plastic such as polypropylene, polyethylene, ABS or the like, which are rather low in strength and in heat resistance for easy assembly. For this reason, it is preferred as in the embodiment of the present invention that the spacer portion 43 is formed with abutment 47 for supporting both the ink absorber 31 and snorkel 25 so as not to move forwards.

Further, a lead portion 39*a* is arranged so as not to be in direct contact with ink absorber 31, and a collector core 7 is interposed therebetween so that ink 2 can be lead out from collector core 7 (FIG. 20).

Collector core 7 is connected with and inserted into ink absorber 31 so as to lead ink 2 required for writing to point assembly 1 and is also connected to lead portion 39*a* so as to deliver ink 2 thereto.

The lead portion 39*a* in this case was configured by providing projections 41*a* defining a lead channel 40 of a small enough gap so that the lead portion can be connected to collector core 7 by contact or via ink held by capillarity. This configuration with projections 41*a* is able to establish a more reliable connection with collector core 7.

It should be noted that lead channel 40 is not necessarily formed by a projective structure or defined by projections 41*a*. It is possible to create a channel 40*a* for leading ink 2 toward air/liquid exchanger 18, by incising the rear end part 19*e* of collector 6*a* (collector's rear end face, for example) as shown in FIG. 22. In FIG. 22, channel 40*a* is connected to air/liquid exchanger 18 via narrow groove 21.

The Operation and Effects of the Second Embodiment

The arrangement of the second embodiment not only provides the functions of the first embodiment but also makes it possible to constantly create a clearance portion that permits air bubbles from air/liquid exchanger 18 to flow smoothly. Since, while the excellent writing performance of a collector writing instrument is thus maintained, the aforementioned clearance portion can be secured even if an event, such as being dropped, which may cause the contents to move, occurs, no problem will occur. That is, this configuration makes adjustment against sharp change in internal pressure so as to provide the function of eliminating the occurrence of flooding and forward leakage in any possible usage situation of writing instruments and hence provides a writing instrument having excellent writing performance.

As the arrangement and functions of the writing instrument according to the second embodiment has been described heretofore, it is possible to suppress the occurrence of writing anomalies due to being dropped or other reasons, and hence secure safe and stable writing performance. In particular, it is possible to provide a writing instrument free from accidental flooding and forward leakage which would have occurred under conditions in which increase and reduction in pressure is repeated, such as in an airplane, as experienced by a businessperson who writes while traveling and who takes multiple flights. The description of the functions and effects brought by the configuration similar to the first embodiment is omitted.

The Third Embodiment

Next, the third embodiment will be detailed with reference to the drawings.

Figure 23:
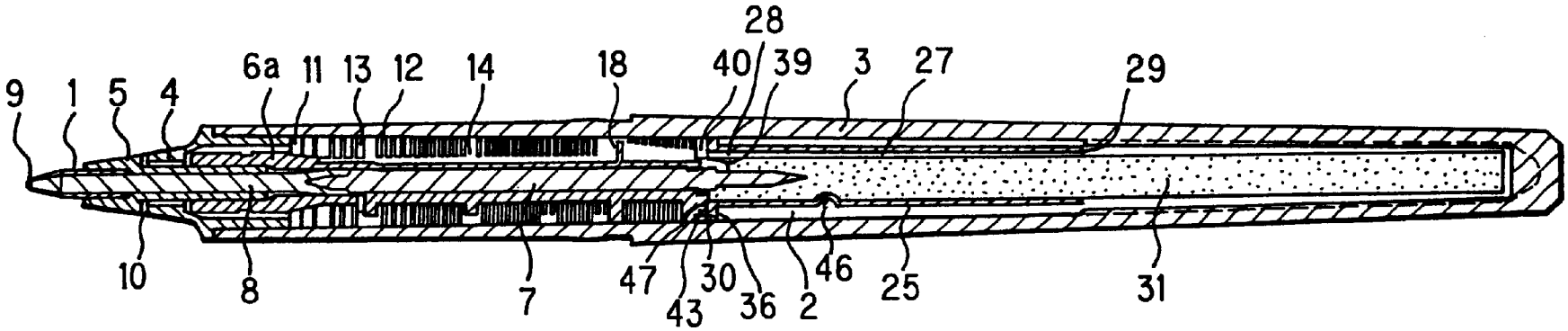
FIG. 23 is a vertical sectional view showing the whole writing instrument of a first example according the third embodiment of the present invention.
Figure 24:
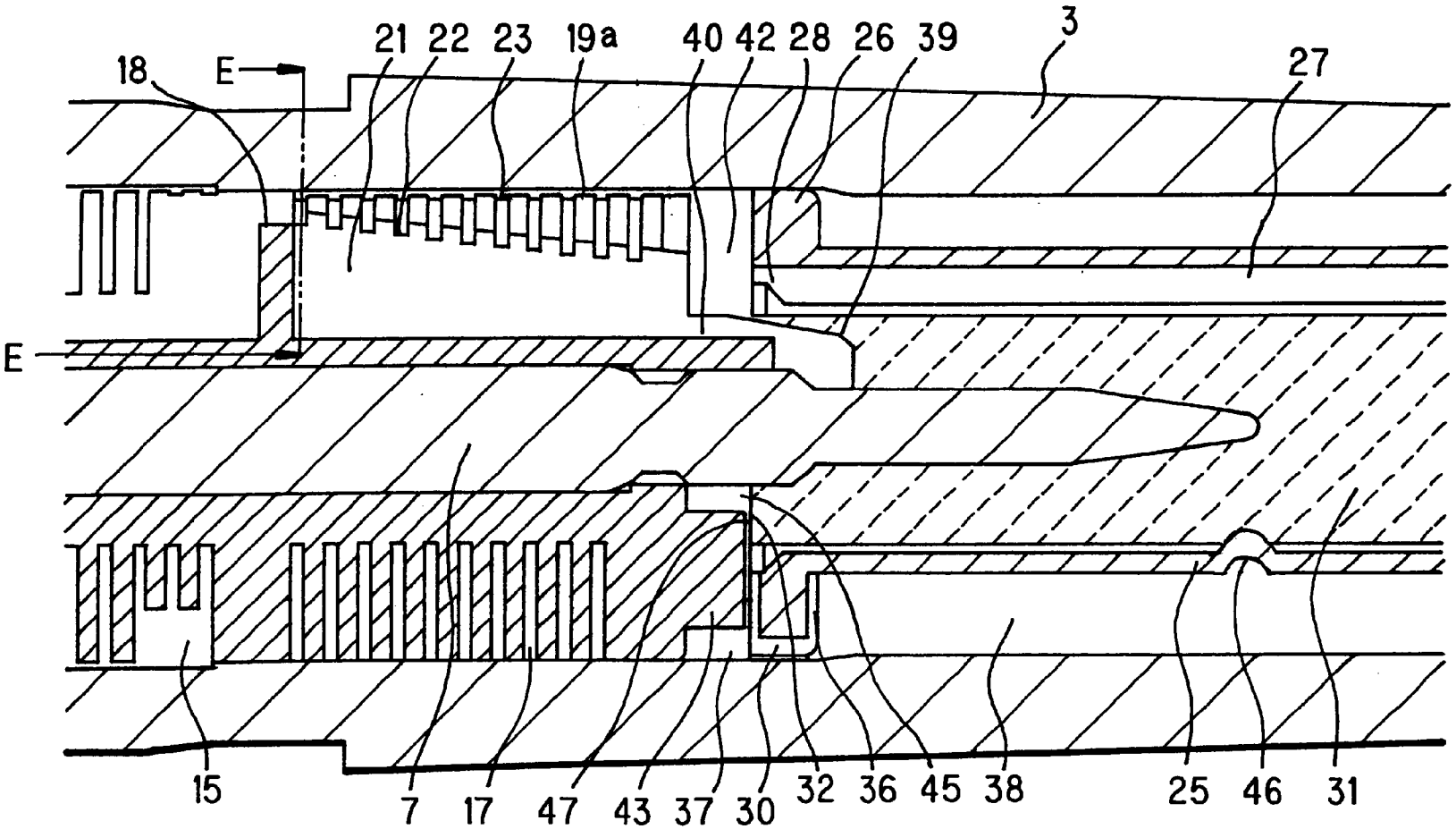
FIG. 24 is an enlarged vertical sectional view showing part of a writing instrument of a first example according to the third embodiment of the present invention.
Figure 25:
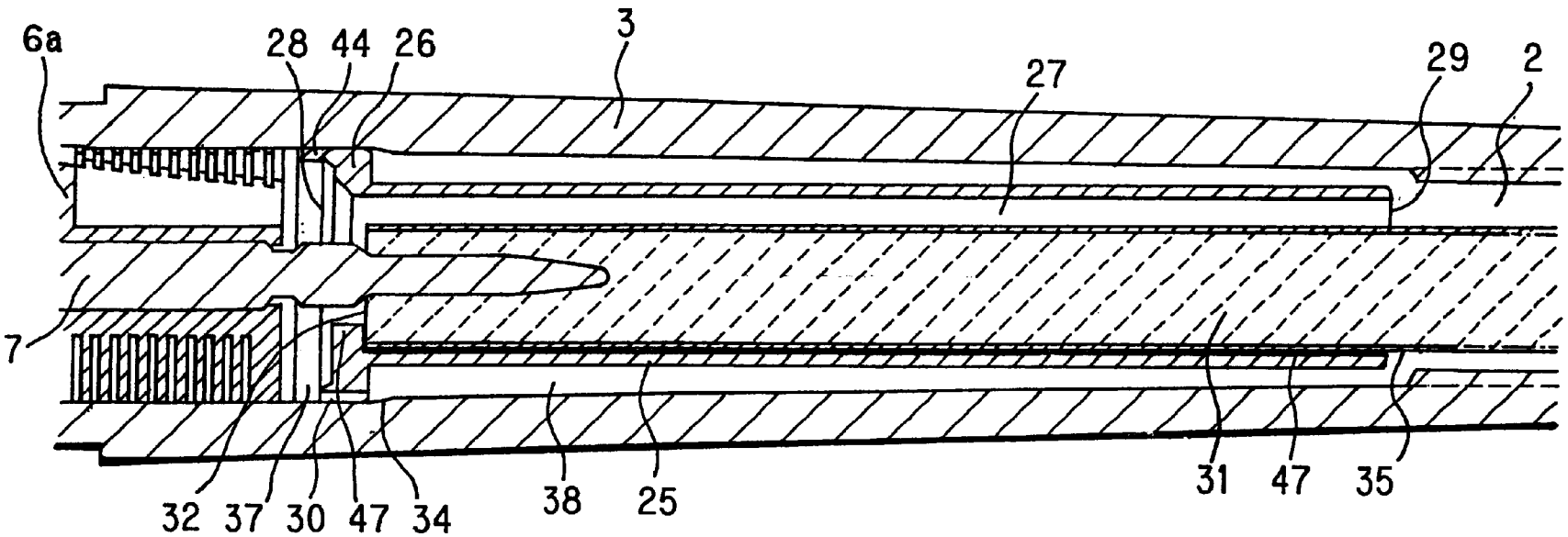
FIG. 25 is an enlarged vertical sectional view showing part of a writing instrument of a second example according to the third embodiment of the present invention.

FIGS. 23 to 25 show the configuration of the present embodiment. FIGS. 23 and 24 show a first example of this embodiment, FIG. 25 shows a second example. Here, FIG. 19 showing the same configuration should also be referred to.

The features of the present embodiment reside in that the parts, present from sectioning portion 26 to the rear end of collector 6*a* except ink tank 3, are integrally molded with, fixed close to with a small enough gap therebetween or fixed in contact with, at least one of ink tank 3, sectioning portion 26 and collector 6*a* while the parts other than ink tank 3 are laid out from sectioning portion 26 to the rear end of collector 6*a* so that ink 2 will be able to spread and wet the surfaces of the parts other than inner wall 34 of ink tank 3.

In sum, since writing instruments are usually kept for a long time with their point assembly 1 up after they are capped, there is a high possibility that almost no ink is present in clearance portion 42 (FIG. 24). When the pen is oriented downwards for writing, it is possible for ink 2 to take a long time to flow out and wet parts up to air/liquid exchanger 18 as already mentioned. However, there happen cases where ink 2 cannot easily flow into the collector 6*a* side (taking some minutes at the maximum) because of presence of sectioning portion 26. In this case, since air/liquid exchanger 18 is not wetted with ink 2, it happens that it is impossible to obtain the proper function of a collector writing instrument i.e., the preventing function of forward leakage from the point assembly by creating a reduced pressure state in ink tank 3 compared to external air, by a meniscus formed when air/liquid exchanger 18 of collector 6*a* is wetted with ink 2. In order to solve the forward leakage problem occurring from such a situation, the embodiment of the present invention is configured so that the flow of ink 2 from the ink tank 3 side up to air/liquid exchanger 18 when the writing instrument is oriented downwards can be assured.

As a specific configuration, in a first example as shown in FIGS. 23, 24 and 20, snorkel 25 and a spacer portion 43 which is integrally formed at the rear end of collector 6*a* are made to contact to each other or are laid out with a gap (preferably about 0.2 mm or smaller) created therebetween.

It is further effective if in order to make ink 2 flow smoothly, the surfaces of the parts from ink conduit 30 to the channel are formed so as to make ink 2 easily flow, or when the surface of collector 6*a* is reformed by a usually applied plasma treatment or chemical treatment so that the surfaces of the parts can easily get wetted.

By the above arrangement, it is possible to avoid the occurrence of a situation in which air/liquid exchanger 18 can not get wetted with ink 2 for some minutes at maximum. That is, it becomes possible to wet air/liquid exchanger 18 with ink 2 within some tens of seconds at maximum (it is faster because some areas of the parts have been usually wetted). Since this time is not so long as to cause leakage of ink 2 at the pen tip in a problematic situation, no forward leakage will occur.

As the second featured configuration, a holder portion 46 that holds ink absorber 31 with a strength at least greater than that which will stop its falling due to gravity is provided in snorkel 25.

The structure of holder portion 46 may be formed in any form as long as it can have the necessary holding effect. For example, partial projections or undercuts, stepped portions to which ink absorber 31 is press fitted can be used, or the whole part of snorkel 25 may be used for press fitting.

Once the parts inside ink tank 3 move either during writing or during being stored, clearance portion 42 functioning as the passage of air bubbles when a sharp change in pressure occurs or during writing may vary in its size and ventilation problems may occur in serious cases. Further, if large gaps form between parts, the function of making ink 2 flow on the surfaces of the parts will be deteriorated. All these problems can be eliminated by the above configuration.

Next, a second example of the third embodiment is shown in FIG. 25.

In this example, a projection 44 is integrally formed with snorkel 25 so that it will be in contact with collector 6*a*, whereby flow of ink 2 along the part surface is assured. Further, an abutment 47 is also integrally formed with snorkel 25. This projection 44 and abutment 47 may be formed as separate parts. However, integration of these parts as in this example makes it possible to reduce the number of parts and hence reduce the cost of products. Other components and functions as well as their effects are the same as the first example.

In the present invention, two parts, ink absorber 31 and snorkel 25, are incorporated in ink tank 3. Such parts entail a high risk of being moved upon being dropped. Use of the inner wall of ink tank 3 or provision of ribs etc. is able to prevent backward movement of these contents, but is inefficient against the forward movement. As to collector 6*a*, since it is put in contact at a number of sites with ink tank 3, it can be press fitted or can be rested on a cap so as not to move. However, since snorkel 25 is wanted to be formed with an extremely thin-walled structure so as not to reduce the loaded amount of ink, it is difficult to fix. Further, since the ink absorber 31 is formed of a bundle of fibers or sponge, this also makes it difficult to fix. This problem can be avoided if these inner parts are firmly fixed so as not to move forwards. However, in general, these parts are formed by molding of a plastic such as polypropylene, polyethylene, ABS or the like, which are rather inferior in strength and heat resistance for easy assembly. For this reason, it is preferred as in the present embodiment that abutment 47 is provided so as to support both the ink absorber 31 and snorkel 25 and prevent forward movement of them.

The Operation of the Third Embodiment

Since the arrangement of the third embodiment makes it possible to always assure the clearance portion that permits air bubbles to flow smoothly from air/liquid exchanger 18, this enables air/liquid exchanger 18 to constantly get wetted with ink 2 without losing the excellent writing performance of a collector writing instrument, whereby the functions of a collector type writing instrument can be always fully achieved.

Further, since the aforementioned clearance portion 42 and the arrangement of the part surfaces along which ink 2 flows can be secured even if an event, such as being dropped, which may cause the contents to move, occurs, no problem will occur. That is, this configuration makes adjustment against sharp change in internal pressure so as to provide the function of eliminating the occurrence of flooding and forward leakage in any possible usage situation of writing instruments and hence provides a writing instrument having excellent writing performance.

As the arrangement and functions of the writing instrument of the third embodiment have been described heretofore, similarly to the above embodiments this embodiment also makes it possible to provide a writing instrument which is slim and stylish and excellent in writing performance. It is also possible to suppress writing anomalies and forward leakage from the pen tip due to usage under varying pressure in an airplane, usage in an environment with change in temperature, pumping phenomena resulting from capping, being dropped or other reasons and hence secure safe and stable writing performance. In particular, it is possible to provide a writing instrument free from flooding and forward leakage problems which would have occurred under conditions in which increase and reduction in pressure is repeated, such as in an airplane, as experienced by a businessperson who writes while traveling and who takes multiple flights.

Further, by the combination with the ink absorber, it is not only possible to improve the safety margin but also solve the ink drop problem and the end of writing life problem at the same time. Thus, this configuration has effective functions as described heretofore compared to conventional configurations and hence contributes to providing a safe collector type writing instrument which is stylish and low in cost, can be easily manufactured and has a long shelf life, without having any deficiencies of the parts for satisfying the use in an airplane.

The Fourth Embodiment

Next, the fourth embodiment will be detailed with reference to FIGS. 2, 4, 5, 24 and 26. Here, for description convenience, FIGS. 2, 4 and 5 are referred to but this embodiment can be also applied to the other embodiments described heretofore.

In this embodiment, snorkel 25 has front opening 28 and rear opening 29. The rear opening 29 is arranged at a position more rearward, with respect to the axial direction, than ink conduit 30 which is formed around the front end of snorkel 25.

When an ample amount of ink 2 is left in ink tank 3, ink flows to the collector 6*a* side also from rear opening 29, and the ink 2 maybe used for writing or temporarily retained in collector 6*a*. At this stage, the air space in ink tank 3 is small, hence expansion or contraction of the space inside due to variation in pressure or due to variation in temperature is smaller compared to the maximum retention volume K of collector 6*a*. Hence no flooding problem will occur.

When the amount of ink 2 left becomes small as it is consumed, the space increases and hence the amount of expansion also increases. However, the expanded air can be released outside via collector 6*a* from rear opening 29 of snorkel 25, so that no flooding problem will occur even when a sharp variation in pressure occurs. In particular, the feature that rear opening 29 is disposed at a position more rearward, with respect to the axial direction, than ink conduit 30 is important to positively release air from tank 3 by way of vent portion 27.

The featured configuration of the present invention is that the following relations 1 and 2 hold:

$$Ts > Is \qquad \text{relation 1:}$$

$$Tt > It, \qquad \text{relation 2:}$$

where Ts (FIG. 5) is the total minimum cross-section of the vent portion 27, Tt (FIG. 4) is the total distance of vent portion 27, Is (FIG. 5) is the total minimum cross-section of ink conduit 30, It (FIG. 4) is the total distance of ink conduit 30, Y is the maximum ink capacity of ink tank 3, K is the maximum retention capacity of collector 6*a* and B (FIGS. 2 and 26) is the minimum width of air/liquid exchanger 18. The width of the air/liquid exchanger indicates the distance of the air/liquid exchanger in the circumferential direction in its cross-section.

As a further effective configuration, the following relations 3 and 4 holds:

$K>Ts\cdot Tt>0.01\cdot Y>Is\cdot It$ relation 3:

$Is>2\cdot B\cdot B$ (two times $B$ squared). relation 4:

In the present embodiment, performance of each example was tested using parts of UB-150 (a product of Mitsubishi Pencil) sold on the market, the result will be described with reference to comparative examples.

As the evaluation items, writing performance (air bubble permeability), flooding behavior upon a sharp variation in pressure, ink pulldown performance with the pen set downward (whether ink flows from rear tank 38 to the collector side) were evaluated.

Evaluation Result is Denoted as Follows:

○ (excellent): free from problems; Δ(good): slightly affected but no problem for practical use; and X(failure): problematic. Other items required for a writing instrument were all validated so that description is omitted.

EXAMPLE 1

Collector's maximum retention volume K=300 $mm^3$ (cubic millimeters)

Vent portion's total minimum cross-section Ts=11.54 $mm^2$: corresponding to ϕ1.4 opening Vent portion's total distance $Tt$=30 mm: $Ts\cdot Tt$=46.2 $mm^3$ Ink conduit's total minimum cross-section $Is$=0.13 $mm^2$:

corresponding to ϕ0.4 opening

Ink conduit's total distance $It$=2 mm: $Is\cdot It$=0.26 $mm^3$

Ink tank's ink capacity $Y$=2000 $mm^3$ (cubic millimeters): 2 cc

Air/liquid exchanger's minimum width $B$=0.15 mm (cross-section $2\cdot B\cdot B$=0.045 $mm^2$)

Evaluation Result

Writing performance: ○ No problem

Flooding behavior: ○ No flooding with enough margin

Ink pulldown performance: ○ to Δ No problem for practical use though ink had slight difficulties to flow down

EXAMPLE 2

Collector's maximum retention volume K=300 $mm^3$ (cubic millimeters)

Vent portion's total minimum cross-section $Ts$=1.0 $mm^2$: corresponding to two ϕ0.8 openings Vent portion's total distance $Tt$=25 mm: $Ts\cdot Tt$=25 $mm^3$ Ink conduit's total minimum cross-section $Is$=0.65 $mm^2$: corresponding to five ϕ0.4 openings Ink conduit's total distance $It$=5 mm: $Is\cdot It$=3.25 $mm^3$ Ink tank's ink capacity $Y$=2000 $mm^3$ (cubic millimeters): 2 cc Air/liquid exchanger's minimum width $B$=0.2 mm (cross-section $2\cdot B\cdot B$=0.08 $mm^2$)

Evaluation Result

Writing performance: Δ No problem for practical use though the mobility of air bubbles was slightly affected causing ink starvation at a slight level Flooding behavior: ○ No flooding Ink pulldown performance: ○ No problem

EXAMPLE 3

Collector's maximum retention volume K=300 $mm^3$ (cubic millimeters)

Vent portion's total minimum cross-section $Ts$=7 $mm^2$: corresponding to one ϕ3 opening Vent portion's total distance $Tt$=40 mm: $Ts\cdot Tt$=280 $mm^3$ Ink conduit's total minimum cross-section $Is$=1.9 $mm^2$: corresponding to three ϕ0.9 openings Ink conduit's total distance $It$=10 mm: $Is\cdot It$=19 $mm^3$ Ink tank's ink capacity $Y$=2000 $mm^3$ (cubic millimeters): 2 cc Air/liquid exchanger's minimum width $B$=0.2 mm (cross-section $2\cdot B\cdot B$=0.08 $mm^2$)

Evaluation Result

Writing performance: ○ No problem

Flooding behavior: Δ No ink flooded but ink almost reached the maximum possible limit of the collector capacity.

Ink pulldown performance: ○ No problem

EXAMPLE 4

Collector's maximum retention volume K=300 $mm^3$ (cubic millimeters)

Vent portion's total minimum cross-section $Ts$=7 $mm^2$: corresponding to one ϕ3 opening Vent portion's total distance $Tt$=40 mm: $Ts\cdot Tt$=280 $mm^3$ Ink conduit's total minimum cross-section $Is$=0.13 $mm^2$: corresponding to one ϕ0.4 opening Ink conduit's total distance $It$=1 mm: $Is\cdot It$=0.13 $mm^3$ Ink tank's ink capacity $Y$=3000 mm$^3$ (cubic millimeters): 3 cc Air/liquid exchanger's minimum width $B$=0.2 mm (cross-section $2 \cdot B \cdot B$=0.08 mm$^2$)

Evaluation Result

Writing performance: ○ No problem

Flooding behavior: Δ No ink flooded but ink almost reached the maximum possible limit of the collector capacity.

Ink pulldown performance: Δ No problem for practical use though ink had slight difficulties to flow down Conventional Example Collector's maximum retention volume K=300 mm$^3$ (cubic millimeters)

Ink tank's ink capacity $Y$=2000 mm$^3$ (cubic millimeters): 2.0 cc

No snorkel and no ink absorber

Evaluation Result

Writing performance: ○ No problem

Flooding behavior: X Ink flooded out upon a sharp reduction in pressure when ink filled to half or lower. (Ink pulldown performance: ○ No problem because of no internal parts)

Comparative Example 1

Collector's maximum retention volume K=300 mm$^3$ (cubic millimeters)

Vent portion's total minimum cross-section $Ts$=14.1 mm$^2$: corresponding to two ϕ3 openings Vent portion's total distance $Tt$=40 mm: $Ts \cdot Tt$=564 mm$^3$ Ink conduit's total minimum cross-section $Is$=0.03 mm$^2$: corresponding to one ϕ0.2 opening Ink conduit's total distance $It$=1 mm: $Is \cdot It$=0.13 mm$^3$ Ink tank's ink capacity $Y$=2000 mm$^3$ (cubic millimeters): 2.0 cc Air/liquid exchanger's minimum width $B$=0.2 mm (cross-section $2 \cdot B \cdot B$=0.08 mm$^2$)

Evaluation Result

Writing performance: ○ No problem

Flooding behavior: X Ink flooded.

Ink pulldown performance: Δ to X Ink did not flow down frequently.

Comparative Example 2

Collector's maximum retention volume K=300 mm$^3$ (cubic millimeters)

Vent portion's total minimum cross-section $Ts$=0.79 mm$^2$: corresponding to one ϕ1 opening Vent portion's total distance $Tt$=30 mm: $Ts \cdot Tt$=23.7 mm$^3$ Ink conduit's total minimum cross-section $Is$=7 mm$^2$: corresponding to one ϕ3 opening Ink conduit's total distance $It$=10 mm: $Is \cdot It$=70 mm$^3$ Ink tank's ink capacity $Y$=2000 mm$^3$ (cubic millimeters): 2.0 cc Air/liquid exchanger's minimum width $B$=0.2 mm (cross-section $2 \cdot B \cdot B$=0.08 mm$^2$)

Evaluation Result

Writing performance: X Ink starvation during writing was observed with no air bubbles able to move, producing adverse effect.

Flooding behavior: Δ to X Ink flowed through the ink conduit causing a large amount of ink to flood out.

Ink pulldown performance: ○ No problem

The Operation of the Fourth Embodiment

The arrangement of the fourth embodiment can further improve the function of positively releasing the expanded air to the outside. Particularly, the optimization of the dimensions of each part of the snorkel and the optimization of the ink tank capacity and the collector capacity realize both the function of preventing ink from flooding when the writing instrument is used in an airplane, which is conceivably the most severe condition, and the function of preventing adverse influence on the writing performance, the visibility of the amount of ink left (appearance), the ink capacity and the like, in compatible manner. Since this configuration provides multiple functions as stated above, it is possible to provide a writing instrument which is stylish and excellent in writing performance and is able to make adjustment against sharp change in internal pressure so as to eliminate the flooding and forward leakage problems in any possible usage situation of the writing instrument.

As the arrangement and functions of the writing instrument of the fourth embodiment have been described heretofore, this embodiment makes it possible to provide a writing instrument which is slim and stylish and excellent in writing performance. It is also possible to suppress writing anomalies and forward leakage from the pen tip due to usage under varying pressure in an airplane, usage in an environment with change in temperature, pumping phenomena resulting from capping, being dropped or other reasons and hence secure safe and stable writing performance. In particular, it is possible to provide a writing instrument free from flooding and forward leakage problems which would have occurred under conditions in which increase and reduction in pressure is repeated, such as in an airplane, as experienced by a businessperson who writes while traveling and who takes multiple flights.

Further, by the combination with the ink absorber and by limitation on the dimensions and other configurations of inner parts, it is not only possible to improve the safety margin but also solve the ink drop problem and the end of writing life problem at the same time. Thus, this configuration provides effective functions as described heretofore compared to conventional configurations and hence contributes to providing an excellent, safe collector type writing instrument which can be easily manufactured and has a long shelf life and excellency in visibility of the amount of ink left at the end of writing life, without having any deficiencies of the parts for satisfying the use in an airplane and which is stylish and low in cost without the necessity of giving special notice to the user.

Though the above description of the embodiments has been made separately for individual features for description convenience, each embodiment or each example can be appropriately combined with others, so as to provide a writing instrument targeted towards a desired purpose.

For the collector, the configuration of collector 6*a* equipped with more desirable, auxiliary retaining grooves 17 was explained. However, it is possible to provide the functions and effects by using a conventional collector 6 which has no auxiliary retaining grooves 17.

Industrial Applicability

The present invention can be applied to collector writing instruments which can be used under a varying pressure environment in an airplane or under an environment in which temperature changes. In particular, the present invention can be applied to writing instruments which are used under conditions in which increase and reduction in pressure is repeated, such as in an airplane, as experienced by a businessperson who writes while traveling and who takes multiple flights.

What is claimed is:

1. A collector type writing instrument including:

a point assembly with a writing point at the tip thereof, an ink tank for storing a low viscosity ink in a free-state ink condition, an ink feeder portion extended from the ink tank to the point assembly, and a collector disposed between the ink tank and the point assembly as an adjuster element for storing ink within a plurality of grooves when an inner pressure is adjusted, the writing instrument characterized in that:

the ink tank is formed therein with a sectioning portion for substantially separating the ink tank and a snorkel having a tubular vent portion for establishing air communication between the front and rear spaces divided by the sectioning portion, an ink conduit of a size smaller than that of the vent portion is arranged in either the sectioning portion or the ink tank inner wall or both, the vent portion of the snorkel has front and rear openings, the rear opening is disposed, with respect to the axial direction, at a position more rearward than the ink conduit, and the arrangement is configured so that the following relations 1 and 2 hold:

$$Ts>Is \quad \text{relation 1:}$$

$$Tt>It, \quad \text{relation 2:}$$

where 'Ts' is a total minimum cross-section of the vent portion, 'Tt' is a total distance of the vent portion, 'Is' is a total minimum cross-section of the ink conduit and 'It' is a total distance of the ink conduit.

2. The collector type writing instrument according to claim 1, further comprising:

an ink absorber which is disposed inside the ink tank and is capable of storing ink and connects with a center core or a collector core which leads ink from the ink tank to the point assembly, wherein the ink absorber is configured so that its length at least reaches to a position more rearward than the approximate center of the ink tank and its radial dimension is sized so as to create a space around itself in the ink tank for permitting free-state ink to move therein and out thereof, and the ink absorber is configured so as to be able to absorb ink at least at its ends, located at a position more frontward than the sectioning portion of the snorkel and at a position more rearward than the rear vent opening of the snorkel.

3. The collector type writing instrument according to claim 1 or 2, wherein the ink absorber has an unabsorbent cladding on the outer peripheral side thereof with openings at only the front and rear ends to allow for suction of ink while the snorkel defines the vent portion and the sectioning portion in combination with the ink absorber or the ink tank inner wall.

4. A collector type writing instrument including:

a point assembly with a writing point at the tip thereof, an ink tank for storing a low viscosity ink in a free-state ink condition, an ink feeder portion extended from the ink tank to the point assembly, and a collector disposed between the ink tank and the point assembly as an adjuster element for storing ink within a plurality of grooves when an inner pressure is adjusted, the writing instrument characterized in that:

the ink tank is formed therein with a sectioning portion for substantially separating the ink tank and a snorkel having a vent portion for establishing air communication between the front and rear spaces divided by the sectioning portion, an ink conduit of a size smaller than that of the vent portion is arranged in either the sectioning portion or the ink tank inner wall or both, a clearance portion allowing for ink and air bubbles to move therethrough is provided between the collector and snorkel, by forming a spacer portion defining the size of the clearance portion, the vent portion of the snorkel has front and rear openings, the rear opening is disposed, with respect to the axial direction, at a position more rearward than an ink conduit, and the arrangement is configured so that the following relations 1 and 2 hold:

$$Ts>Is \quad \text{relation 1:}$$

$$Tt>It, \quad \text{relation 2:}$$

where 'Ts' is a total minimum cross-section of the vent portion, 'Tt' is a total distance of the vent portion, 'Is' is a total minimum cross-section of the ink conduit and 'It' is a total distance of the ink conduit.

5. The collector type writing instrument according to claim 4, further comprising:

an ink absorber which is disposed inside the ink tank and is capable of storing ink and connects with a center core or a collector core which leads ink from the ink tank to the point assembly, wherein the ink absorber is configured so that its length at least reaches to a position more rearward than the approximate center of the ink tank and its radial dimension is sized so as to define a space around itself in the ink tank for permitting free-state ink to move therein and out thereof, the ink absorber is configured so as to be able to absorb ink at least through its front and rear openings, and the space portion is formed with an air bubble passage channel that will not block at least part around the front end of the ink absorber and an abutment for limiting the forward movement of the ink absorber.

6. The collector type writing instrument according to claim 4 or 5, wherein the spacer portion is integrally formed at the rear end of the collector.

7. A collector type writing instrument including:

a point assembly with a writing point at the tip thereof, an ink tank for storing a low viscosity ink in a free-state ink condition, an ink feeder portion extended from the ink tank to the point assembly, and a collector disposed between the ink tank and the point assembly as an adjuster element for storing ink within a plurality of grooves when an inner pressure in the ink tank is adjusted, the writing instrument characterized in that:

the ink tank is formed therein with a sectioning portion for substantially separating the ink tank and a snorkel having a vent portion for establishing air communication between the front and rear spaces divided by the sectioning portion, an ink conduit of a size smaller than that of the vent portion is arranged in either the sectioning portion or the ink tank inner wall or both, a clearance portion allowing for ink and air bubbles to move therethrough is provided between the collector and the sectioning portion, the parts present from the sectioning portion to a rear end of the collector, except the ink tank, are integrally molded, fixed close to with a small enough gap therebetween or fixed in contact with at least one of the ink tank, sectioning portion, and collector while the parts present from the sectioning portion to the rear end of the collector, except the ink tank, are laid out so that ink will be able to spread and wet the surfaces of the parts other than the ink tank inner wall, the vent portion of the snorkel has front and rear openings, the rear opening is disposed, with respect to the axial direction, at a position more rearward than the ink conduit, and the arrangement is configured so that the following relations 1 and 2 hold:

$$Ts>Is \qquad \text{relation 1:}$$

$$Tt>It, \qquad \text{relation 2:}$$

where 'Ts' is a total minimum cross-section of the vent portion, 'Tt' is a total distance of the vent portion, 'Is' is a total minimum cross-section of the ink conduit and 'It' is a total distance of the ink conduit.

8. The collector type writing instrument according to claim 7, further comprising:

an ink absorber which is disposed inside the ink tank, is capable of storing ink and connects with a center core or a collector core which leads ink from the ink tank to the point assembly, wherein the ink absorber is configured so that its length at least reaches to a position more rearward than the approximate center of the ink tank and so as to be able to absorb ink through the front and rear openings, and the snorkel is formed with a holder portion providing friction against the ink absorber so as to hold it with a strength at least greater than that which will stop the ink absorber falling due to gravity when the writing instrument is put stationarily.

9. The collector type writing instrument according to claim 7, further comprising:

an ink absorber which is disposed inside the ink tank, is capable of storing ink, and connects with a center core or a collector core which leads ink from the ink tank to the point assembly.

wherein the ink absorber is configured so that its length at least reaches to a position more rearward than the approximate center of the ink tank and so as to be able to absorb ink through the front and rear openings, and the snorkel has an abutment formed of a stepped portion for at least preventing the Ink absorber from moving toward the point assembly.

10. A collector type writing instrument including a point assembly with a writing point at the tip thereof, an ink tank for storing a low viscosity ink in a free-state ink condition, an ink feeder portion extended from the ink tank to the point assembly, and a collector disposed between the ink tank and the point assembly as an adjuster element for storing ink within a plurality of grooves when an inner pressure is adjusted, the writing instrument characterized in that:

the ink tank is formed therein with a snorkel which, integrally or as separate parts, includes a sectioning portion for substantially separating the ink tank, a vent portion for establishing air communication between the front and rear spaces is divided by the sectioning portion, and an ink conduit for establishing ink communication between the divided front tank and rear tank, the vent portion of the snorkel has front and rear openings the rear opening is disposed, with respect to the axial direction, at a position more rearward than the ink conduit, and the arrangement is configured so that the following relations 1 and 2 hold:

relation I : TS > Is relation 2 Tt > It, where 'Ts' is a total minimum cross-section of the vent portion, 'Tt' is a total distance of the vent portion. 'Is' is a total minimum cross-section of the ink conduit and 'It' is a total distance of the ink conduit.

11. The collector type writing instrument according to claim 10, further comprising:

an ink absorber which is disposed inside the ink tank, is capable of storing ink, and connects with a center core or a collector core which leads ink from the ink tank to the point assembly, wherein the ink absorber is configured so as to be able to absorb ink by its part, at least, extending from a position more frontward to a position more rearward with respect to an approximate center of a portion where free-state ink is stored in the ink tank, through at least both the front and rear parts, a space which allows ink to flow and permits the amount of ink left to be checked from an outside is defined around the ink absorber by the ink tank, collector and the ink absorber, the rear opening of the snorkel is made to open at the approximate center of the portion where free-state ink is stored in the ink tank, and the front opening of the snorkel is made to open at a position close to a rear end of the collector.

12. The collector type writing instrument according to claim 10 or 11, wherein all the following relations 3 and 4 hold:

relation 3 : $K > Ts \cdot Tt > 0.01 \cdot Y > Is \cdot It$ relation 4 : $Is > 2 \cdot B^2$, where 'TS' is the total minimum cross-section of the vent portion. 'Tt' is the total distance of the vent portion. 'Is' is the total minimum cross-section of the ink conduit. 'It' is the total distance of the ink conduit, 'Y' is a maximum ink capacity of the ink tank, 'K' is a maximum ink retention capacity of the collector and 'B' is a minimum width of an air/liquid exchanger.

13. The collector type writing instrument according to any one of claims, 1, 4, 7 and 10, wherein an end portion of the vent portion of the snorkel is formed with a beveled portion.

* * * * *